US008294533B2

(12) United States Patent
Dupuy et al.

(10) Patent No.: US 8,294,533 B2
(45) **Date of Patent: *Oct. 23, 2012**

(54) POWER COMBINERS AND DIVIDERS BASED ON COMPOSITE RIGHT AND LEFT HANDED METAMATERIAL STRUCTURES

(75) Inventors: Alexandre Dupuy, San Diego, CA (US); Ajay Gummalla, San Diego, CA (US); Maha Achour, Encinitas, CA (US)

(73) Assignee: Hollinworth Fund, L.L.C., Dover, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/896,179

(22) Filed: Oct. 1, 2010

(65) Prior Publication Data

US 2011/0109402 A1 May 12, 2011

Related U.S. Application Data

(63) Continuation of application No. 11/963,710, filed on Dec. 21, 2007, now Pat. No. 7,839,236.

(51) Int. Cl.
*H01P 5/12* (2006.01)

(52) U.S. Cl. ..... 333/136; 333/236; 333/246

(58) Field of Classification Search ..... 333/112, 333/118, 125, 127, 128, 134, 136, 168, 23, 333/204, 236, 246

See application file for complete search history.

(56) References Cited

U.S. PATENT DOCUMENTS

| | | | |
|---|---|---|---|
| 6,310,788 | B1 | 10/2001 | Myer |
| 6,320,478 | B1 | 11/2001 | Sims, III |
| 6,859,114 | B2 | 2/2005 | Eleftheriades et al. |
| 7,068,949 | B2 | 6/2006 | Jung et al. |
| 7,129,894 | B1 | 10/2006 | Winter |
| 7,193,562 | B2 | 3/2007 | Shtrom et al. |
| 7,330,090 | B2 | 2/2008 | Itoh et al. |
| 7,391,288 | B1 | 6/2008 | Itoh et al. |
| 7,446,712 | B2 | 11/2008 | Itoh et al. |
| 7,482,893 | B2 | 1/2009 | Itoh et al. |
| 7,508,283 | B2 | 3/2009 | Itoh et al. |
| 7,592,957 | B2 | 9/2009 | Achour et al. |
| 7,839,236 | B2 | 11/2010 | Dupuy et al. |
| 2005/0253667 | A1 | 11/2005 | Itoh et al. |
| 2008/0001684 | A1 | 1/2008 | Itoh et al. |
| 2008/0048917 | A1 | 2/2008 | Archour et al. |
| 2008/0204327 | A1 | 8/2008 | Lee et al. |

(Continued)

FOREIGN PATENT DOCUMENTS

WO WO-2009085941 A1 7/2009

(Continued)

OTHER PUBLICATIONS

"U.S. Appl. No. 11/963,710, Final Office Action mailed May 27, 2010", 11 pgs.

(Continued)

*Primary Examiner* — Robert Pascal
*Assistant Examiner* — Kimberly Glenn
(74) *Attorney, Agent, or Firm* — Connolly Bove Lodge & Hutz LLP

(57) ABSTRACT

Techniques, apparatus and systems that use composite left and right handed (CRLH) metamaterial structures to combine and divide electromagnetic signals at multiple frequencies. The metamaterial properties permit significant size reduction over a conventional N-way radial power combiner or divider. Dual-band serial power combiners and dividers and single-band and dual-band radial power combiners and dividers are described.

27 Claims, 25 Drawing Sheets

U.S. PATENT DOCUMENTS

2009/0160575 A1 6/2009 Dupuy et al.
2010/0171563 A1 7/2010 Dupuy et al.

FOREIGN PATENT DOCUMENTS

WO WO-2010077978 A2 7/2010

OTHER PUBLICATIONS

"U.S. Appl. No. 11/963,710, Non Final Office Action mailed Feb. 22, 2010", 18 pgs.
"U.S. Appl. No. 11/963,710, Notice of Allowance mailed Aug. 6, 2010", 10 pgs.
"U.S. Appl. No. 11/963,710, Response filed Feb. 23, 2010 to Non Final Office Action mailed Feb. 22, 2010", 26 pgs.
"U.S. Appl. No. 11/963,710, Response filed Jun. 22, 2010 to Final Office Action mailed May 27, 2010", 26 pgs.
"International Application Serial No. PCT/US2008/087409, International Search Report and Written Opinion filed Dec. 18, 2008", 14 pgs.
"International Application Serial No. PCT/US2009/068307, International Search Report and Written Opinion mailed Jul. 30, 2010", 8 Pgs.
Antoniades, A, et al., "A Broadband Series Power Divider Using Zero-Degree Metamaterial Phase-Shifting Lines", IEEE Microwave and Wireless Components Letters 15(11), (Nov. 2005), 808-810.
Caloz, Christophe, et al., "Electromagnetic Metamaterials: Transmission Line Theory and Microwave Applications", John Wiley & Sons, (2006), 186 pgs.
Chang, K, et al., "Millimeter-Wave Power-Combining Techniques", IEEE Transactions on Microwave Theory and Techniques, MTT 31(2), (Feb. 1983), 91-107.
Collin, "Field Theory of Guided Waves", John Wiley & Sons, Inc., 2nd Ed., (Dec. 1990).
Damm, C., et al., "Artificial Line Phase Shifter with separately tunable Phase and Line Impedance", 36th European Microwave Conference, (2006), 423-426.
Dupuy, A, et al., "Power Combining Tunnel Diode Oscillators using Metamaterial Transmission Line at Infinite Wavelength Frequency", IEEE MTT-S International Microwave Symposium Digest 2006, (Sep. 2007), 751-754.
Itoh, T, "Invited Paper: Prospects for Metamaterials", Electronics Letters, 40 (16), (Aug. 2004), 972-973.
Kenney, J.S., et al., "A Novel Design of Frequency Tripler Using Composite Right/Left handed Transmission Line", Microwave Symposium, IEEE/MTT-S International, (Jun. 2007), 2185-2188.
Kim, D.J., et al., "Switched Microstrip Array Antenna for RFID System", Proceedings fo the 38th European Microwave Conference, Amsterdam The Netherlands, (Oct. 2008), 1254-1257.
Lai, A, et al., "A Novel N-Port Series Divider Using Infinite Wavelength Phenomena", 2005 IEEE MTT-S International Microwave Symposium Digest, (Jun. 2005), 1001-1004.
Lai, A, et al., "Composite right/left handed transmission line metamaterials.", IEEE Microwave Magazine (Sep. 2004), 34-50.
Lai, Anthony, et al., "Infinite Wavelength Resonant Antennas with Monopolar Radiation Pattern Based on Periodic Structures", IEEE Transactions on Antennas and Propagation, 55(3), (Mar. 2007), 868-876.
Lee, C-H, et al., "Novel T/R Switch Architectures for MIMO Applications", IEEE Microwave Theory and Techniques Society, International Microwave Symposium Digest, (2004), 1137-1140.
Lee, D, et al., "Advanced Design of Planar Spiral Antenna with Novel Feeding Network", International Conference on Electromagnetics in Advanced Applications, (Sep. 2007), 551-554.
Lee, T.K., et al., "Power amplifier/low noise amplifier RF switch", Electronics Letters, vol. 36 No. 24, (Nov. 23, 2000), 1983-1984.
Li, H.et al, "The Bragg Gap on One-Dimensional Composite Right/Left-Handed Transmission Line", Asia Pacific Microwave Conference Proceedings, vol. 3, (Dec. 2005), 4-7.
Mao, S, et al., "Broadband Composite Right/Left-Handed Coplanar Waveguide Power Splitters with Arbitrary Phase Responses and Balun and Antenna Applications", IEEE Transactions on Antennas and Propagation, 54(1), (Jan. 2006), 243-250.
Matthaie, G, et al., "Microwave Filters, Impedance-Matching Networks, and Coupling Structures", Artech House, Inc., (1980).
Mekanand, P, et al., "Double Pole Fourth Throw CMOS Switch in a Transceiver if MIMO Systems", 11th International Conference on Advanced Communication Technology 2009, (Feb. 15-18, 2009), 472-474.
Mortazawi, A, et al., "A Periodic Planar Gunn Diode Power Combining Oscillator", IEEE Transactions on Microwave Theory and Techniques, 38(1), (Jan. 1990), 86-87.
Pozar, David M, "Microwave Engineering", 3rd ed., John Wiley & Sons, (2005).

Composite ($\beta=\beta_L+\beta_R$) Left and Right Handed Metamaterial Dispersion Diagram Values of the CRLH:
$L_L$=4.119nH, $C_L$=1.6448pF
$C_R$=1.0347pF, $L_R$=2.5868nH.

Measured:
$|S_{21@2.528GHz}|$= -0.603dB
$|S_{11@2.528GHz}|$= -28.027dB

Measured:
$|S_{21@2.425GHz}|$= -0.631dB
$|S_{11@2.425GHz}|$= -30.391dB $$Z_{\frac{\lambda}{4}@f_1,\ \frac{3\lambda}{4}@f_2} = \sqrt{50 * \frac{50}{N}}$$

POWER COMBINERS AND DIVIDERS BASED ON COMPOSITE RIGHT AND LEFT HANDED METAMATERIAL STRUCTURES

This application is a continuation of U.S. patent application Ser. No. 11/963,710, filed Dec. 21, 2007 and entitled "Power Combiners And Dividers Based On Composite Right And Left Handed Metamaterial Structures." The entire disclosure of the above application is incorporated herein by reference. This application relates to metamaterial (MTM) structures and their applications.

BACKGROUND

The propagation of electromagnetic waves in most materials obeys the right handed rule for the (E,H,β) vector fields, where E is the electrical field, H is the magnetic field, and β is the wave vector. The phase velocity direction is the same as the direction of the signal energy propagation (group velocity) and the refractive index is a positive number. Such materials are "right handed" (RH). Most natural materials are RH materials. Artificial materials can also be RH materials.

A metamaterial is an artificial structure. When designed with a structural average unit cell size p much smaller than the wavelength of the electromagnetic energy guided by the metamaterial, the metamaterial can behave like a homogeneous medium to the guided electromagnetic energy. Different from RH materials, a metamaterial can have a structure to exhibit a negative refractive index where the phase velocity direction is opposite to the direction of the signal energy propagation and the relative directions of the (E,H,β) vector fields follow the left handed rule. Metamaterials that support only a negative index of refraction are "left handed" (LH) metamaterials.

Many metamaterials are mixtures of LH metamaterials and RH materials and thus are Composite Left and Right Handed (CRLH) metamaterials. A CRLH metamaterial can behave like a LH metamaterials at low frequencies and a RH material at high frequencies. Designs and properties of various CRLH metamaterials are described in, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004).

CRLH metamaterials can be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

SUMMARY

This application describes, among others, techniques, apparatus and systems that use composite left and right handed (CRLH) metamaterial structures to combine and divide electromagnetic signals.

In one implementation, a CRLH metamaterial device for dividing or combining power includes a dielectric substrate; a main CRLH transmission line comprising CRLH unit cells coupled in series and a plurality of branch CRLH transmission lines each comprising of CRLH unit cells coupled in series. Each CRLH unit cell in the main transmission line is structured to have a first electrical length that corresponds to a phase of zero degree, 180 degrees or a multiple of 180 degrees at a first signal frequency and a second, different electrical length that corresponds to a phase of zero degree, 180 degrees or a multiple of 180 degrees at a second, different signal frequency. Each branch transmission line CRLH unit cell is structured to have a third electrical length that corresponds to a phase of 90 degrees or an odd multiple of 90 degrees at the first signal frequency and a fourth electrical length that is different from the third electrical length and corresponds to a phase of 90 degrees or an odd multiple of 90 degrees at the second signal frequency. The branch transmission lines are connected at different locations on the main CRLH transmission line.

In another implementation, a CRLH metamaterial device for dividing or combining power includes a dielectric substrate; and a main CRLH resonator comprising CRLH unit cells coupled in series and CRLH branch transmission lines comprising of CRLH unit cells coupled in series. Each CRLH unit cell in the main CRLH resonator is structured to have a first electrical length that corresponds to a phase of zero degree, 180 degrees or a multiple of 180 degrees at a first signal frequency and a second, different electrical length that corresponds to a phase of zero degree, 180 degrees or a multiple of 180 degrees at a second, different signal frequency. A branch transmission line CRLH unit cell is structured to have a third electrical length that corresponds to a phase of 90 degrees or an odd multiple of 90 degrees at the first signal frequency and a fourth electrical length that is different from the third electrical length and corresponds to a phase of 90 degrees or an odd multiple of 90 degrees at the second signal frequency. The plurality of branch transmission lines are capacitively coupled at arbitrarily different locations on the main CRLH resonator with a capacitor.

In another implementation, a CRLH metamaterial device for dividing or combining power includes a dielectric substrate; a plurality of branch CRLH transmission lines each formed on the substrate to have an electrical length that corresponds to a phase of zero degree, 180 degrees or a multiple of 180 degrees at an operating signal frequency, and a main feedline. Each branch CRLH transmission line has a first terminal and a second terminal. The main signal feed line is formed on the substrate and includes a first feed line terminal and a second feed line terminal. The second feed line terminal is electrically coupled to the second terminals of the branch CRLH transmission lines to combine power from the branch CRLH transmission lines to output a combined signal at the second feed line terminal or to distribute power in a signal received at the first feed line terminal into signals directed to the second terminals of the branch CRLH transmission lines for output at the respect first terminals of the branch CRLH transmission lines, respectively. The electrical length of each branch CRLH transmission line can correspond to a phase of zero degree to reduce a physical dimension of the device. The main feedline can be a conventional right hand conductor feed line or a CRLH transmission line. The conventional transmission is optimal when the power combiner is used in a switch configuration, where one branch line is connected to the main feedline and the rest of plural branches are disconnected. The main CRLH transmission line is optimal when plurality of the branch CRLH lines are simultaneously connected. In this case the main CRLH transmission line is structured to have an electrical length that corresponds to a phase of 90 degrees or an odd multiple of 90 degrees at the operating signal frequency.

In another implementation, a CRLH metamaterial device for dividing or combining power includes a dielectric substrate, a main feedline; and branch CRLH transmission lines each formed on the substrate to have a first electrical length that corresponds to a first phase value selected from zero degree, 180 degrees or a multiple of 180 degrees at a first operating signal frequency and a second electrical length that corresponds to a second, different phase value selected from zero degree, 180 degrees or a multiple of 180 degrees at a second, different signal frequency. Each branch CRLH transmission line has a first terminal and a second terminal. The main signal feed line is formed on the substrate and has a first feed line terminal and a second feed line terminal. The second feed line terminal is electrically coupled to the second terminals of the branch CRLH transmission lines to combine power from the branch CRLH transmission lines to output a combined signal at the second feed line terminal or to distribute power in a signal received at the first feed line terminal into signals directed to the second terminals of the branch CRLH transmission lines for output at the respect first terminals of the branch CRLH transmission lines, respectively. Each branch CRLH transmission line can be configured to have a third electrical length that is different from the first and second electrical lengths at a third, different signal frequency. The main feedline can be a conventional RH or a CRLH transmission line. The conventional transmission line is optimal when the power combiner is used in a switch configuration, where one branch line is connected to the main feedline and the rest of plural branches are disconnected. The main CRLH transmission line is optimal when plurality of the branch CRLH lines is simultaneously connected. In this case the main CRLH transmission line is structured to have a third electrical length that corresponds to a phase of 90 degrees or an odd multiple of 90 degrees at the first signal frequency and a fourth electrical length that is different from the third electrical length and corresponds to a phase of 90 degrees or an odd multiple of 90 degrees at the second signal frequency.

In yet another implementation, a method for dividing or combining power based on CRLH metamaterial structures includes using at least two CRLH transmission lines each having an electrical length that corresponds to a phase of zero degree, 180 degrees or a multiple of 180 degrees at an operating signal frequency; and electrically connecting one terminal of a signal feed line as a common electrical connect to one terminals of the at least two CRLH transmission lines to combine power from the CRLH transmission lines to output a combined signal at the operating signal frequency or to distribute power in a signal received by the feed line terminal at the operating signal frequency to the CRLH transmission lines, respectively.

In yet another implementation, a CRLH metamaterial device for dividing or combining power includes a dielectric substrate and a CRLH transmission line comprising CRLH unit cells coupled in series. Each CRLH unit cell is structured to have a first electrical length that corresponds to a phase of zero degree, 180 degrees or a multiple of 180 degrees at a first signal frequency and a second, different electrical length that corresponds to a phase of zero degree, 180 degrees or a multiple of 180 degrees at a second, different signal frequency. This device includes a first CRLH feed line connected to a first location on the CRLH transmission line and comprising at least one CRLH unit cell that has a third electrical length that corresponds to a phase of 90 degrees or an odd multiple of 90 degrees at the first signal frequency and a fourth electrical length that is different from the third electrical length and corresponds to a phase of 90 degrees or an odd multiple of 90 degrees at the second signal frequency. This device also includes a second CRLH feed line connected to a second location on the CRLH transmission line and comprising at least one CRLH unit cell that has the third electrical length at the first signal frequency and the fourth electrical length at the second signal frequency.

In yet another implementation, a CRLH metamaterial device for dividing or combining power includes a dielectric substrate and a CRLH transmission line comprising CRLH unit cells coupled in series. Each CRLH unit cell is structured to have a first electrical length that corresponds to a phase of zero degree, 180 degrees or a multiple of 180 degrees at a first signal frequency and a second, different electrical length that corresponds to a phase of zero degree, 180 degrees or a multiple of 180 degrees at a second, different signal frequency. This device includes a transmission line capacitor connected in series to one end of the CRLH transmission line; a first port capacitor having a first terminal connected to a first location on the CRLH transmission line and a second terminal; a first CRLH feed line connected to the second terminal of the first port capacitor to be capacitively coupled to the CRLH transmission line and comprising at least one CRLH unit cell that has a third electrical length that corresponds to a phase of 90 degrees or an odd multiple of 90 degrees at the first signal frequency and a fourth electrical length that is different from the third electrical length and corresponds to a phase of 90 degrees or an odd multiple of 90 degrees at the second signal frequency; a second port capacitor having a first terminal connected to a second location on the CRLH transmission line and a second terminal; and a second CRLH feed line connected to a second terminal of the second port capacitor to be capacitively coupled to the CRLH transmission line and comprising at least one CRLH unit cell that has the third electrical length at the first signal frequency and the fourth electrical length at the second signal frequency.

In yet another implementation, a CRLH metamaterial device for dividing or combining power includes a dielectric substrate; and a dual-band CRLH transmission line comprising of a plurality of CRLH unit cells coupled in series. Each CRLH unit cell has a first electrical length that is a multiple of +/−180 degrees at the first signal frequency and a second, different electrical length that is a different multiple of +/−180 degrees at the second signal frequency. This device includes a first CRLH feed line electrically coupled to a first location on the dual-band CRLH transmission line comprising of at least one CRLH unit cell that has a third electrical length that is an odd multiple of +/−90 degrees at the first signal frequency and a fourth, different electrical length that is a different odd multiple of +/−90 degrees at the second signal frequency; and a second CRLH feed line capacitively coupled to a second location on the dual-band CRLH transmission line comprising of at least one CRLH unit cell that has the third electrical length at the first signal frequency and the fourth electrical length at the second signal frequency.

These and other implementations can be used to achieve one or more advantages in various applications, such as compact RF power combiners and dividers, and dual-band or multi-band operations of RF power combiners and dividers.

These and other implementations and their variations are described in detail in the attached drawings, the detailed description and the claims.

DETAILED DESCRIPTION

A pure LH material follows the left hand rule for the vector trio (E,H,β) and the phase velocity direction is opposite to the signal energy propagation. Both the permittivity and permeability of the LH material are negative. A CRLH Metamaterial can exhibit both left hand and right hand electromagnetic modes of propagation depending on the regime or frequency of operation. Under certain circumstances, a CRLH metamaterial can exhibit a non-zero group velocity when the wavevector of a signal is zero. This situation occurs when both left hand and right hand modes are balanced. In an unbalanced mode, there is a bandgap in which electromagnetic wave propagation is forbidden. In the balanced case, the dispersion curve does not show any discontinuity at the transition point of the propagation constant $\beta(\omega_o)=0$ between the Left and Right handed modes, where the guided wavelength is infinite $\lambda_g=2\pi/|\beta|\rightarrow\infty$ while the group velocity is positive:

$$v_g = \left.\frac{d\omega}{d\beta}\right|_{\beta=0} > 0$$

This state corresponds to the Zeroth Order mode m=0 in a Transmission Line (TL) implementation in the LH handed region. The CRHL structure supports a fine spectrum of low frequencies with a dispersion relation that follows the negative β parabolic region which allows a physically small device to be built that is electromagnetically large with unique capabilities in manipulating and controlling near-field radiation patterns. When this TL is used as a Zeroth Order Resonator (ZOR), it allows a constant amplitude and phase resonance across the entire resonator. The ZOR mode can be used to build MTM-based power combiners and splitters or dividers, directional couplers, matching networks, and leaky wave antennas. Examples of MTM-based power combiners and dividers are described below.

In RH TL resonators, the resonance frequency corresponds to electrical lengths $\theta_m=\beta_m l=m\pi$ (m=1, 2, 3, . . . ), where l is the length of the TL. The TL length should be long to reach low and wider spectrum of resonant frequencies. The operating frequencies of a pure LH material are at low frequencies. A CRLH metamaterial structure is very different from RH and LH materials and can be used to reach both high and low spectral regions of the RF spectral ranges of RH and LH materials. In the CRLH case $\theta_m=\beta_m l=m\pi$, where l is the length of the CRLH TL and the parameter m=0, ±1, ±2, ±3, . . . , ±∞.

Figure 1A:
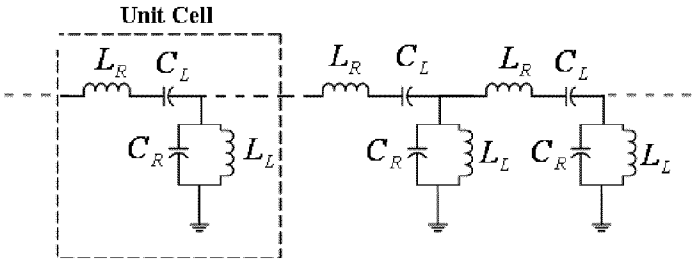
FIG. 1A shows a CRLH transmission line (TL) having CRLH unit cells.

FIG. 1A illustrates an equivalent circuit of a MTM transmission line with at least three MTM unit cells connected in series in a periodic configuration. The equivalent circuit for each unit cell has a right-handed (RH) series inductance $L_R$, a shunt capacitance $C_R$ and a left-handed (LH) series capacitance $C_L$, and a shunt inductance $L_L$. The shunt inductance $L_L$ and the series capacitance $C_L$ are structured and connected to provide the left handed properties to the unit cell. This CRLH TL can be implemented by using distributed circuit elements, lumped circuit elements or a combination of both. Each unit cell is smaller than λ/10 where λ is the wavelength of the electromagnetic signal that is transmitted in the CRLH TL. CRLH TLs possess interesting phase characteristics such, as anti-parallel phase, group velocity, non-linear phase slope and phase offset at zero frequency.

Figure 1B:
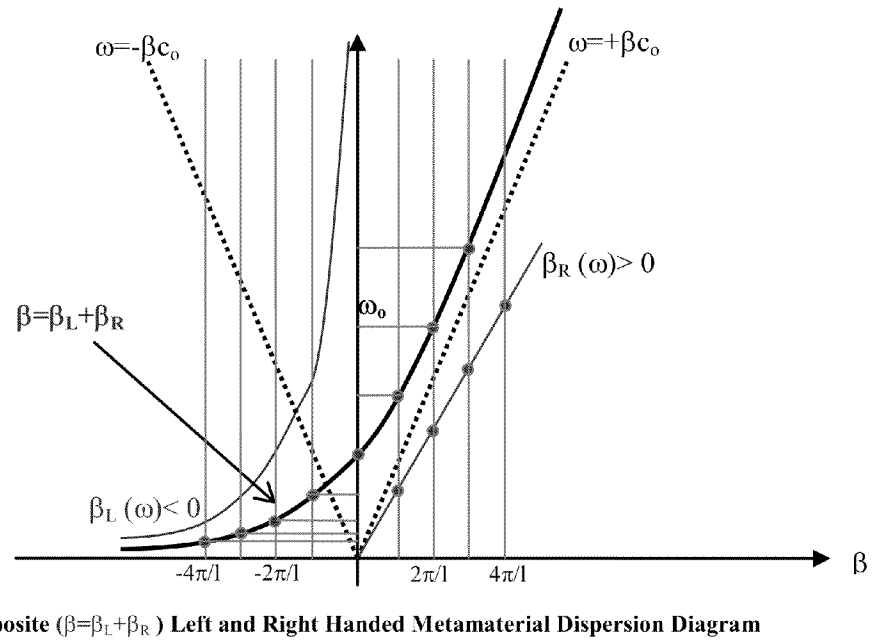
FIG. 1B shows the dispersion diagram of a CRLH unit cell.

FIG. 1B shows the dispersion diagram of a balanced CRLH metamaterial unit cell in FIG. 1A. The CRLH structure can support a fine spectrum of low frequencies and produce higher frequencies including the transition point with m=0 that corresponds to infinite wavelength. This can be used to provide integration of CRLH antenna elements with directional couplers, matching networks, amplifiers, filters, and power combiners and splitters. In some implementations, RF or microwave circuits and devices may be made of a CRLH MTM structure, such as directional couplers, matching networks, amplifiers, filters, and power combiners and splitters.

Referring back to FIG. 1A, in the unbalanced case where $L_RC_L\neq L_LC_R$, two different resonant frequencies exist: $\omega_{se}$ and $\omega_{sh}$ that can support an infinite wavelength given by:

$$\omega_{sh} = \frac{1}{\sqrt{C_R L_L}}, \text{ and } \omega_{se} = \frac{1}{\sqrt{C_L L_R}}.$$

At $\omega_{se}$ and $\omega_{sh}$ the group velocity ($v_g=d\omega/d\beta$) is zero and the phase velocity ($v_p=\omega/\beta$) is infinite. When the series and shunt resonances are equal: $L_RC_L=L_LC_R$ the structure is said to be balanced, and the resonant frequencies coincide:

$$\omega_{se}=\omega_{sh}=\omega_0.$$

For the balanced case, the phase response can be approximated by:

$$\varphi_C = \varphi_{RH} + \varphi_{LH} = -\beta l = -\frac{Nl\omega}{c}$$

$$\varphi_{RH} \approx -N2\pi f\sqrt{L_R C_R}$$

$$\varphi_{LH} \approx \frac{N}{2\pi f\sqrt{L_L C_L}}$$

where N is the number of unit cells. The slope of the phase is given by:

$$\frac{d\varphi_{CRLH}}{df} = -N2\pi\sqrt{L_R C_R} - \frac{N}{2\pi f^2\sqrt{L_L C_L}}$$

The characteristic impedance is given by:

$$Z_0^{CRLH} = \sqrt{\frac{L_R}{C_R}} = \sqrt{\frac{L_L}{C_L}}.$$

The inductance and capacitance values can be selected and controlled to create a desired slope for a chosen frequency. In addition, the phase can be set to have a positive phase offset at DC. These two factors are used to provide the designs of multi-band and other MTM power combining and dividing structures presented in this specification.

The following sections provide examples of determining MTM parameters of dual-band mode MTM structures and similar techniques can be used to determine MTM parameters with three or more bands.

In a dual-band MTM structure, the signal frequencies $f_1$, $f_2$ for the two bands are first selected for two different phase values: $\phi_1$ at $f_1$ and $\phi_2$ at $f_2$. Let N be the number of unit cells in the CRLH TL and $Z_t$, the characteristic impedance. The values for parameters $L_R$, $C_R$, $L_L$ and $C_L$ can be calculated:

$$L_R = \frac{Z_t\left[\phi_1\left(\frac{\omega_1}{\omega_2}\right) - \phi_2\right]}{N\omega_2\left[1 - \left(\frac{\omega_1}{\omega_2}\right)^2\right]},$$

$$C_R = \frac{\phi_1\left(\frac{\omega_1}{\omega_2}\right) - \phi_2}{N\omega_2 Z_t\left[1 - \left(\frac{\omega_1}{\omega_2}\right)^2\right]},$$

$$L_L = \frac{NZ_t\left[1 - \left(\frac{\omega_1}{\omega_2}\right)^2\right]}{\omega_1\left[\phi_1 - \left(\frac{\omega_1}{\omega_2}\right)\phi_2\right]},$$

$$C_L = \frac{N\left[1 - \left(\frac{\omega_1}{\omega_2}\right)^2\right]}{\omega_1 Z_t\left[\phi_1 - \left(\frac{\omega_1}{\omega_2}\right)\phi_2\right]}$$

$$Z_0^{CRLH} = \sqrt{\frac{L_R}{C_R}} = \sqrt{\frac{L_L}{C_L}}$$

In the unbalanced case, the propagation constant is given by:

$$\beta = s(\omega)\sqrt{\omega^2 L_R C_R + \frac{1}{\omega^2 L_L C_L} - \left(\frac{L_R}{L_L} + \frac{C_R}{C_L}\right)}$$

$$\text{With } s(\omega) = \begin{cases} -1 & \text{if } \omega < \min(\omega_{se}, \omega_{sh}) : LH \text{ range} \\ +1 & \text{if } \omega > \max(\omega_{se}, \omega_{sh}) : RH \text{ range} \end{cases}$$

For the balanced case:

$$\beta = \omega\sqrt{L_R C_R} - \frac{1}{\omega\sqrt{L_L C_L}}$$

A CRLH TL has a physical length of d with N unit cells each having a length of p: d=N·p. The signal phase value is $\phi = -\beta d$. Therefore, $$\beta = -\frac{\phi}{d}, \text{ and}$$

$$\beta_i = -\frac{\phi_i}{(N \cdot p)}$$

It is possible to select two different phases $\phi_1$ and $\phi_2$ at two different frequencies $f_1$ and $f_2$, respectively:

$$\begin{cases} \beta_1 = \omega_1\sqrt{L_R C_R} - \frac{1}{\omega_1\sqrt{L_L C_L}} \\ \beta_2 = \omega_2\sqrt{L_R C_R} - \frac{1}{\omega_2\sqrt{L_L C_L}}. \end{cases}$$

In comparison, a conventional RH microstrip transmission line exhibits the following dispersion relationship:

$$\beta_n = \beta_0 + \frac{2\pi}{p}n,\ n = 0, \pm 1, \pm 2, \ldots\ .$$

See, for example, the description on page 370 in Pozar, Microwave Engineering, 3rd Edition and page 623 in Collin, Field Theory of Guided Waves, Wiley-IEEE Press; 2 Edition (Dec. 1, 1990).

Dual- and multi-band CRLH TL devices can be designed based on a matrix approach described in U.S. patent application Ser. No. 11/844,982 entitled "Antennas Based on Metamaterial Structures" and filed on Aug. 24, 2007, which is incorporated by reference as part of the specification of this application. Under this matrix approach, each 1D CRLH transmission line includes N identical cells with shunt ($L_L$, $C_R$) and series ($L_R$, $C_L$) parameters. These five parameters determine the N resonant frequencies and phase curves, corresponding bandwidth, and input/output TL impedance variations around these resonances.

The frequency bands are determined from the dispersion equation derived by letting the N CRLH cell structure resonates with nπ propagation phase length, where n=0, ±1, . . . , ±(N−1). That means, a zero and 2π phase resonances can be accomplished with N=3 CRLH cells. Furthermore, a tri-band power combiner and splitter can be designed using N=5 CRLH cells where zero, 2π, and 4π cells are used to define resonances.

The n=0 mode resonates at $\omega_0 = \omega_{SH}$ and higher frequencies are given by the following equation for the different values of M specified in Table 1:

For $n > 0$, $$\omega_{\pm n}^2 = \frac{\omega_{SH}^2 + \omega_{SE}^2 + M\omega_R^2}{2} \pm \sqrt{\left(\frac{\omega_{SH}^2 + \omega_{SE}^2 + M\omega_R^2}{2}\right)^2 - \omega_{SH}^2\omega_{SE}^2}\ .$$

Table 1 provides M values for N=1, 2, 3, and 4.

TABLE 1

Resonances for N = 1, 2, 3 and 4 cells

| | Modes | | | |
|---|---|---|---|---|
| N | \|n\| = 0 | \|n\| = 1 | \|n\| = 2 | \|n\| = 3 |
| N = 1 | M = 0; $\omega_0 = \omega_{SH}$ | | | |
| N = 2 | M = 0; $\omega_0 = \omega_{SH}$ | M = 2 | | |
| N = 3 | M = 0; $\omega_0 = \omega_{SH}$ | M = 1 | M = 3 | |
| N = 4 | M = 0; $\omega_0 = \omega_{SH}$ | M = 2 − $\sqrt{2}$ | M = 2 | |

Figure 2:
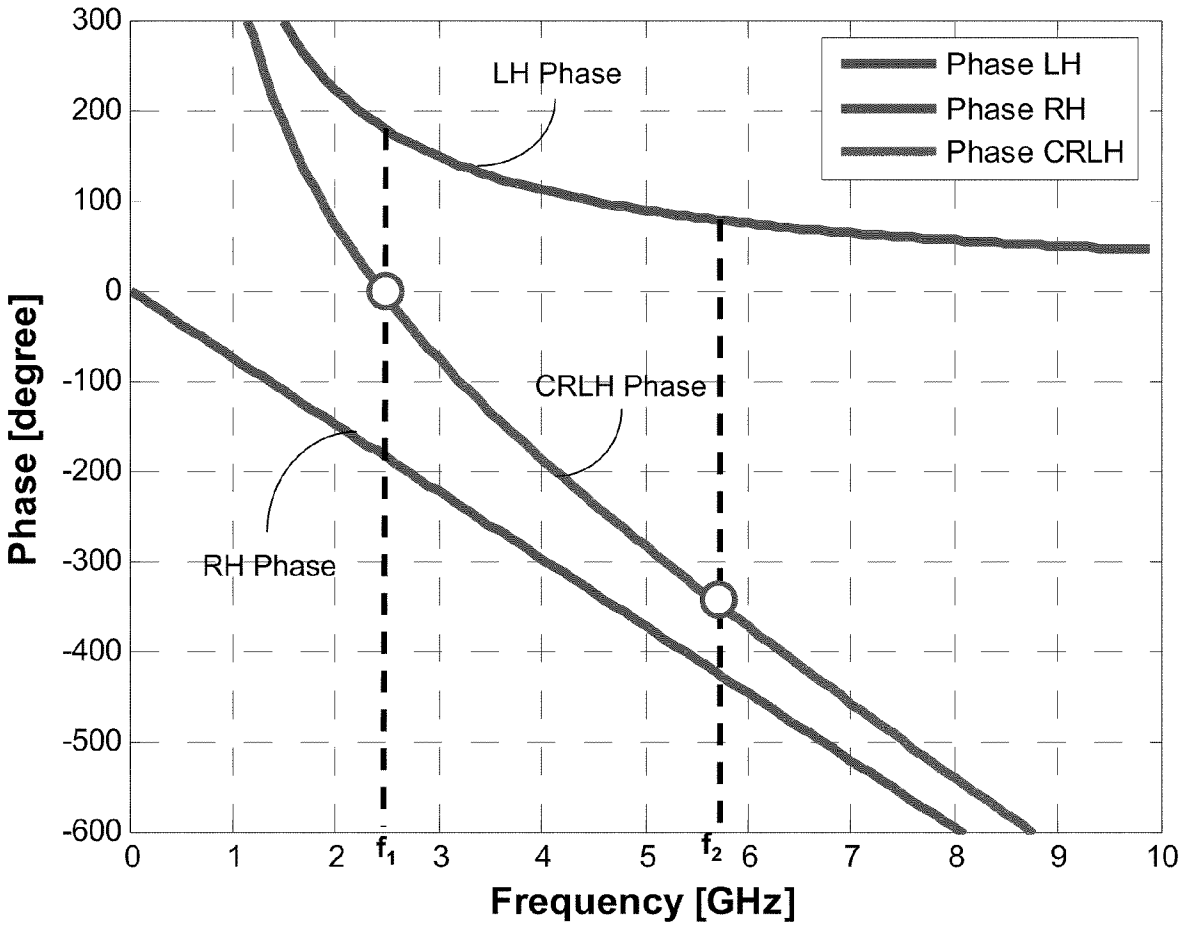
FIG. 2 shows an example of the phase response of a CRLH TL which is a combination of the phase of the RH and the phase of the LH.

FIG. 2 shows an example of the phase response of a CRLH TL which is a combination of the phase of the RH components and the phase of the LH components. Phase curves for CRLH, RH and LH transmission lines are shown. The CRLH phase curve approaches to the LH TL phase tt low frequencies and approaches to the RH TL phase at high frequencies. Notably, the CRLH phase curve crosses the zero-phase axis with a frequency offset from zero. This offset from zero frequency enables the CRLH curve to be engineered to intercept a desired pair of phases at any arbitrary pair of frequencies. The inductance and capacitance values of the LH and RH can be selected and controlled to create a desired slope with a positive offset at the zero frequency (DC). By way of example, FIG. 2 shows that the phase chosen at the first frequency $f_1$ is 0 degree and the phase chosen at the second frequency $f_2$ is −360 degrees. In addition, a CRLH TL can be used to obtain an equivalent phase with a much smaller footprint than a RH transmission line.

Hence, CRLH power combiners and dividers can be designed for combining and dividing signals at two or more different frequencies under impedance matched conditions to achieve compact devices that are smaller than conventional combiners and dividers. Referring back to FIG. 1A, each CRLH unit cell can be designed based on different unit configurations in CRLH power combiners and dividers. The use of the properties of the metamaterial offers new possibilities for different types of design for dual-frequencies but also for quad-band systems.

FIGS. 3A-3E illustrate examples of CRLH unit cell designs. The shunt inductance $L_L$ and the series capacitance $C_L$ are structured and connected to provide the left handed properties to the unit cell and thus are referred to as the LH shunt inductance $L_L$ and the LH series capacitance $C_L$.

Figure 3A:
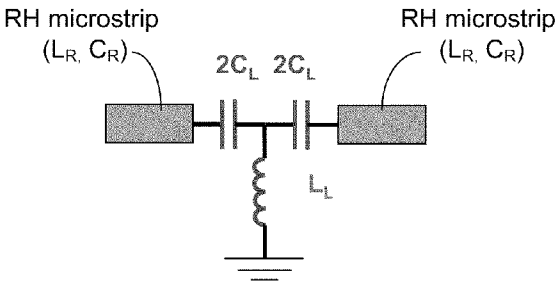
FIGS. 3A, 3B, 3C, 3D, 3E, 4A, 4B, 5, 6A, 6B, 6C, 7A, 7B, 7C, 8A, 8B, 8C, 9A, 9B, and 9C show examples of CRLH unit cells.

FIG. 3A shows a symmetric CRLH unit cell design with first and second LH series capacitors coupled between first and second RH microstrips and a LH shunt inductor coupled between the two LH series capacitors and the ground. The first series capacitor is electromagnetically coupled to the first right handed microstrip and the second series capacitor is electromagnetically coupled to the first LH series capacitor. The LH shunt inductor has a first terminal that is electromagnetically coupled to both the first and second LH series capacitors and has a second terminal that is electrically grounded. The right handed microstrip is electromagnetically coupled to the second LH series capacitor.

Figure 3B:
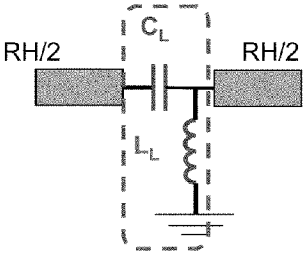
Figure 3C:
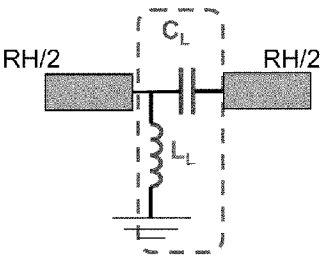
Figure 3D:
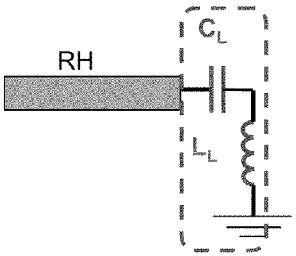
Figure 3E:
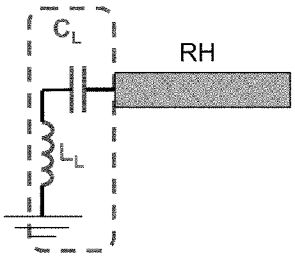

FIGS. 3B-3E show various asymmetric CRLH unit cell designs. In FIG. 3B, the CRLH unit cell includes first a right handed microstrip, a LH series capacitor electromagnetically coupled to the first right handed microstrip, a LH shunt inductor having a first terminal that is electromagnetically coupled to the first LH series capacitor, a second right handed microstrip electromagnetically coupled to the LH series capacitor and the first terminal of the LH shunt inductor. The LH shunt inductor has a second terminal that is electrically grounded. In FIG. 3C, the CRLH unit cell includes a first right handed microstrip, a LH series capacitor electromagnetically coupled to the first right handed microstrip, a LH shunt inductor having a first terminal that is electromagnetically coupled to the first LH series capacitor, a second right handed microstrip electromagnetically coupled to the LH series capacitor. The first terminal of the LH shunt inductor is electromagnetically coupled to first right handed microstrip and wherein the LH shunt inductor has a second terminal that is electrically grounded. In FIGS. 3D and 3E, the CRLH unit cell includes a right handed microstrip, a LH series capacitor electromagnetically coupled to the first right handed microstrip, a LH shunt inductor having a first terminal that is electromagnetically coupled to the LH series capacitor and is not directed coupled to the right handed microstrip, and a second terminal that is electrically grounded.

Each unit cell can be in a "mushroom" structure which includes a top conductive patch formed on the top surface of a dielectric substrate, a conductive via connector formed in the substrate 201 to connect the top conductive patch to the ground conductive patch. Various dielectric substrates can be used to design these structures, with a high or a low dielectric constant and varying heights. It is also possible to reduce the footprint of this structure by using a "vertical" technology, i.e., by way of example a multilayer structure or on Low Temperature Co-fired Ceramic (LTCC).

The values of $L_L$, $C_L$, $C_R$ and $L_R$ at two different frequencies, for example, $f_1$=2.44 GHz and $f_2$=5.85 GHz, with a phase of $(0+2\pi n)$ at $f_1$ and $-2\pi(n+1)$ at $f_2$, with n= . . . , −1, 0, 1, 2, . . . . In these examples, lumped elements are used to model the left-handed capacitors and the left-handed inductors can be realized by, e.g., using shorted stubs to minimize the loss. The RH part is modeled by using a conventional RH microstrip with an electrical length determined by $C_R$ and $L_R$. The number of unit cells is defined by N(=l/d), where d is the length of the unit cell and l is the length of the CRLH transmission line. For example, a unit cell can be designed by with a phase of zero degree at $f_1$ and a phase of −360 degree at $f_2$. A two-cell CRLH cell can use the following calculated values $L_L$=2.0560 nH, $C_L$=0.82238 pF, $C_R$=2.0694 pF and $L_R$=5.1735 nH. It can be noticed that $L_RC_L=C_RL_L$ and $$Z_o^{CRLH} = \sqrt{\frac{L_R}{C_R}} = \sqrt{\frac{L_L}{C_L}} = 50\Omega Z_0 = \sqrt{\frac{L_R}{C_R}} = \sqrt{\frac{L_L}{C_L}} = 50\Omega,$$

which is the balanced case, $\omega_{se}=\omega_{sh}$. Such a CRLH TL can be implemented by using an FR4 substrate with the values of H=31 mil (0.787 mm) and $\in_r$=4.4.

Figure 4A:
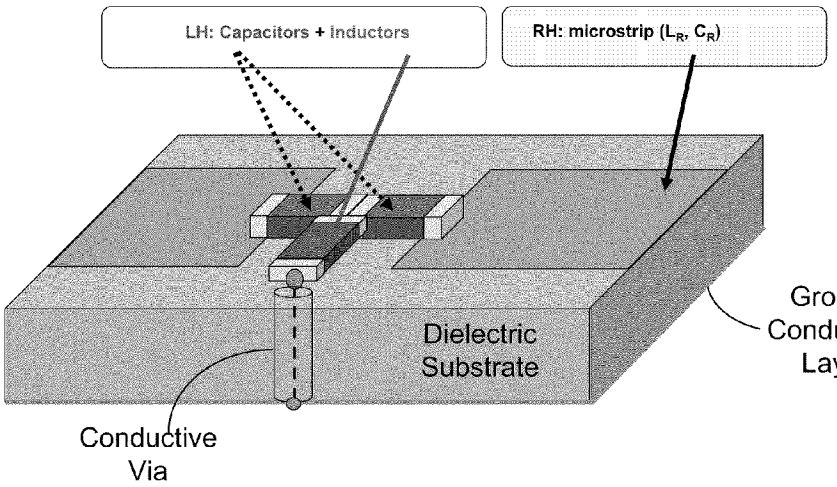
Figure 4B:
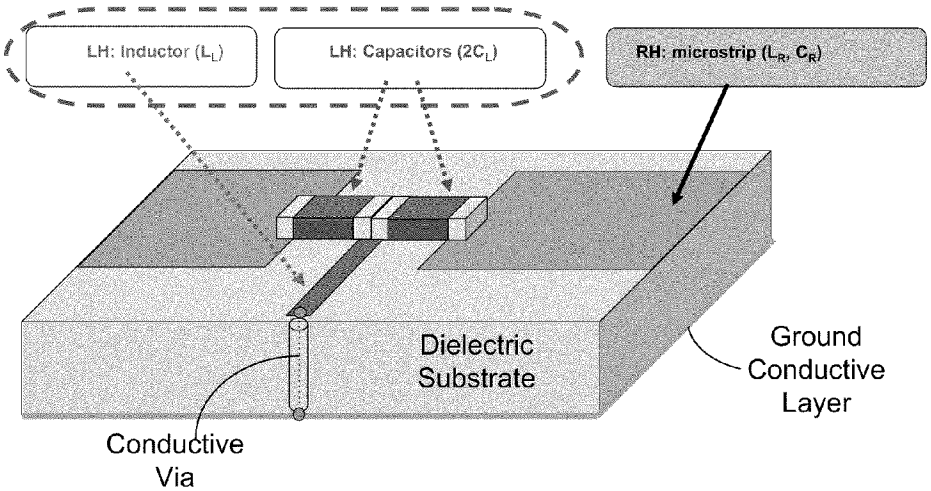

FIGS. 4A and 4B show two exemplary implementations of the symmetric CRLH unit cell design in FIG. 2A with lumped elements for the LH part and microstrip for the right hand part. In FIG. 4A, the LH shunt inductor is a lumped inductor element formed on the top of the substrate. In FIG. 4B, the LH shunt inductor is a printed inductor element formed on the top of the substrate.

Figure 5:
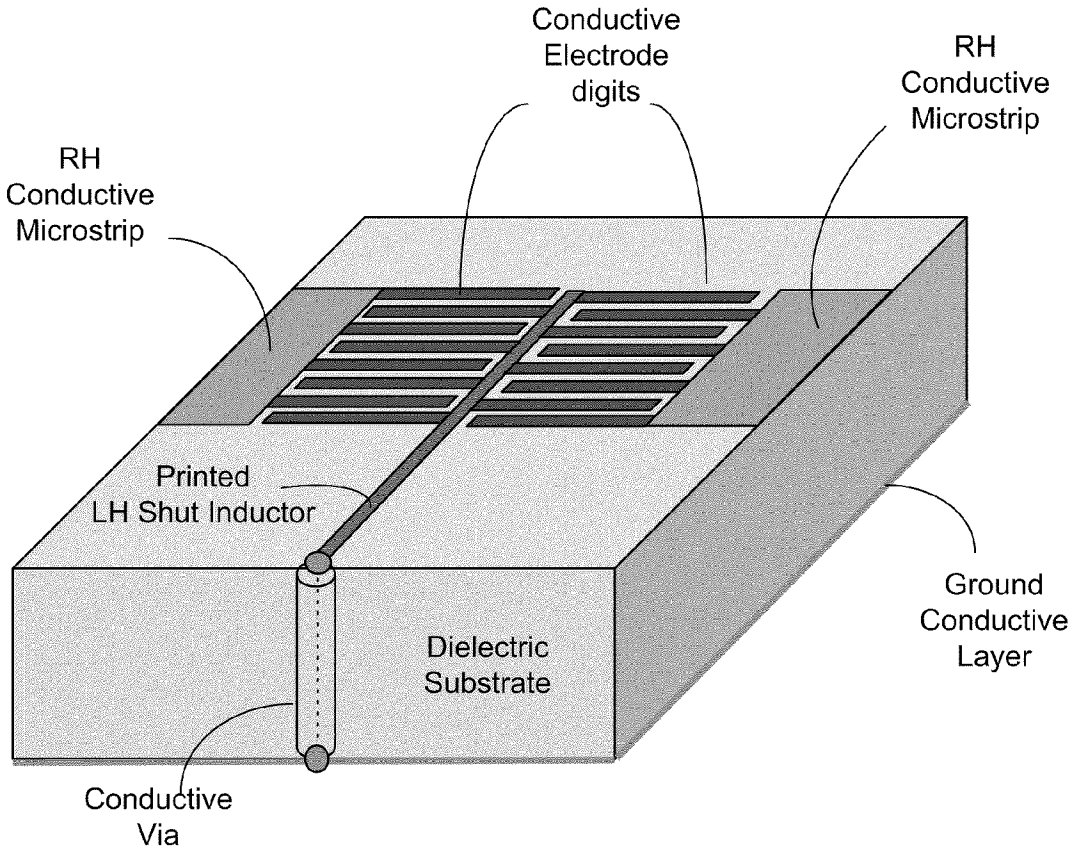

FIG. 5 shows an example of a CRLH unit cell design based on distributed circuit elements. This unit cell includes two RH conductive microstrips and a LH series interdigital capacitor, and a printed LH shunt inductor. The interdigital capacitor includes three sets of electrode digits with a first set of electrode digits connected between one RH microstrip and a second set of electrode digits connected to the other RH microstrip. The third set of electrode digits is connected to the shunt inductor. The three sets of electrode digits are spatially interleaved to provide capacitive coupling and an electrode digit in one set is adjacent to electrode digits from two other sets.

Figure 6A:
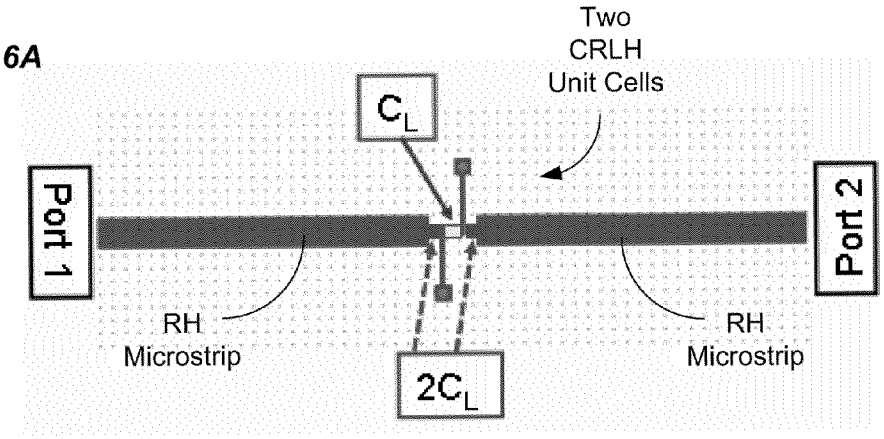

FIG. 6A presents an example of a dual-band transmission line with two CRLH unit cells. Each CRLH unit cell is configured to have a phase of 0 degree at a first signal frequency $f_1$ and a phase of −360 degrees at a second signal frequency $f_2$. As a specific example, the first frequency $f_1$ is chosen to be 2.44 GHz and the second signal frequency $f_2$ is chosen to be 5.85 GHz. The parameters for this TL are: $L_L$=2.0560 nH, $C_L$=0.82238 pF, $C_R$=2.0694 pF and $L_R$=5.1735 nH.

Figure 6B:
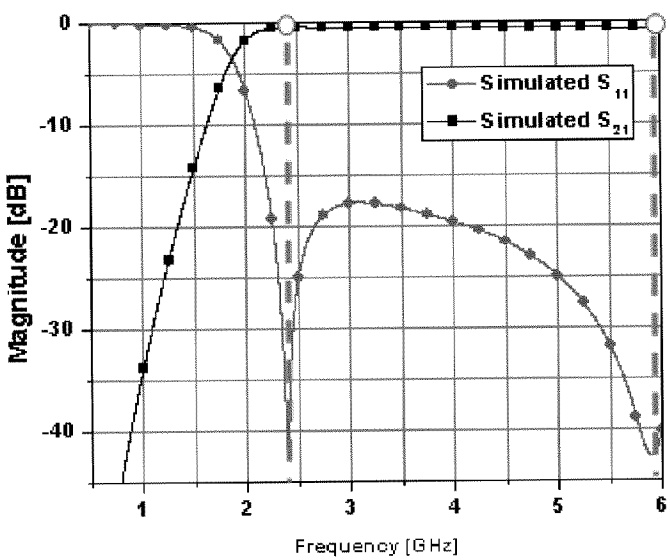

FIG. 6B displays the measured magnitude of this dual-band CRLH TL unit cell, with $|S_{21@2.44\ GHz}|$=−0.48 dB and $|S_{21@2.44\ GHz}|$=−0.71 dB. The losses observed can be attributed to the FR4 substrate. These losses can be easily reduced by using a substrate with less loss. It can be observed that there is no cutoff at high frequency for this dual-band unit cell CRLH TL that is likely due to the fact that the RH is implemented with microstrip. In this example, the cutoff frequency for the high-pass induced by the LH is calculated from:

$$f_{cLH} = \frac{1}{4\pi\sqrt{L_L C_L}} = 1.9353 \text{ GHz}$$

Figure 6C:
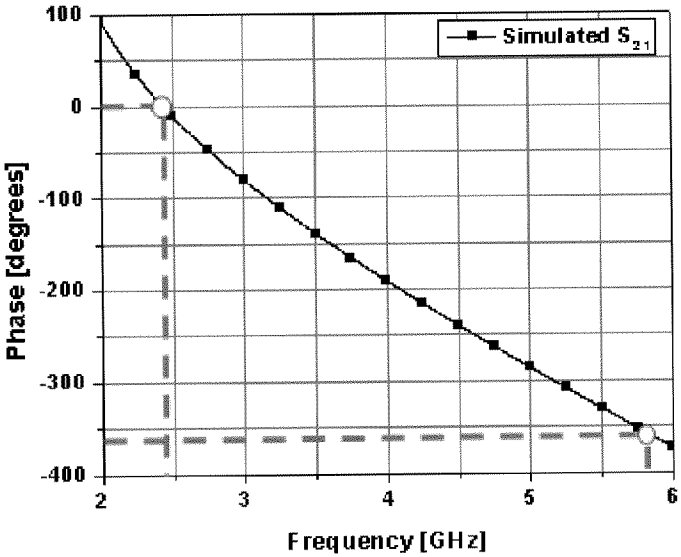

FIG. 6C shows the phase values of this dual-band CRLH TL unit cell: $S_{21@2.44\ GHz}=0°$ and $S_{21@5.85\ GHz}=-360°$.

Figure 7A:
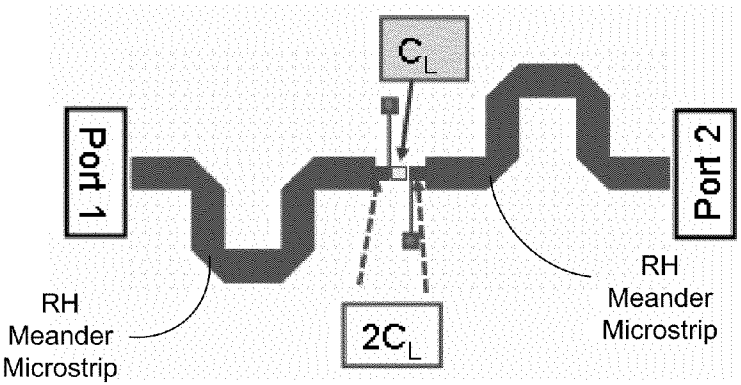
Figure 7B:
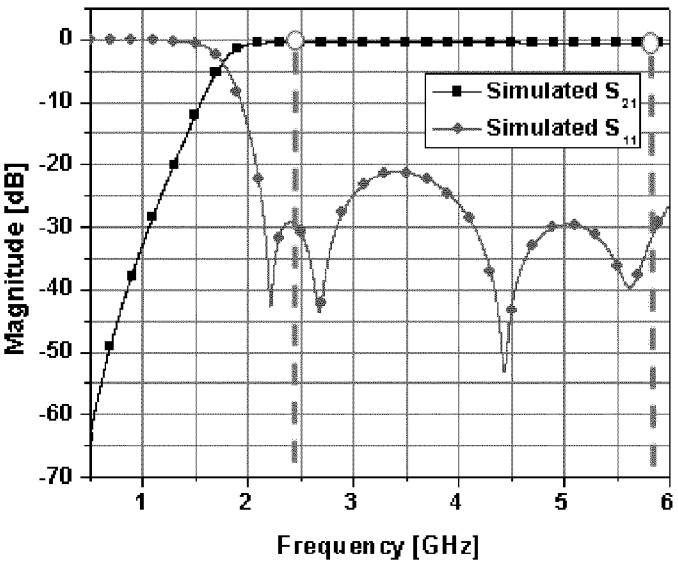
Figure 7C:
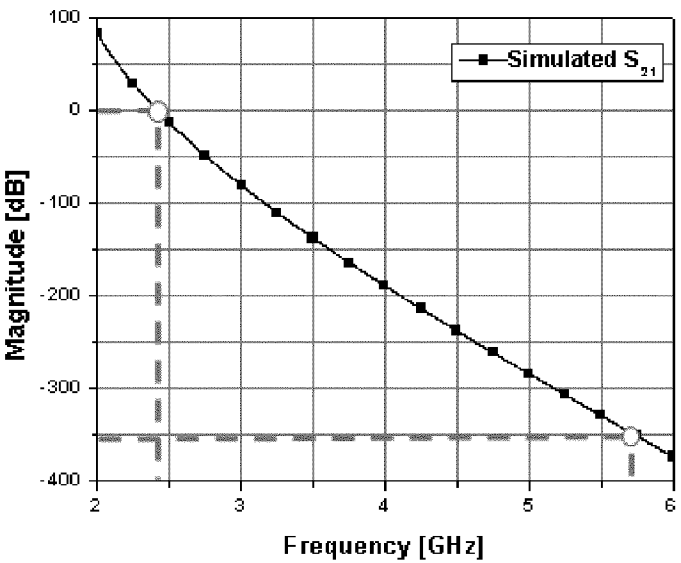

FIG. 7A another example of a dual-band CRLH transmission line using RH meander microstrips to reduce the size of the dual-band CRLH TL unit cell while keeping similar performance parameters as in the TL in FIG. 6A. The parameters for this TL are: $L_L$=2.0560 nH, $C_L$=0.82238 pF, $C_R$=2.0694 pF and $L_R$=5.1735 nH. FIG. 7B displays the magnitude of this dual-band CRLH TL meander with $|S_{21@2.44\ GHz}|=-0.35$ dB and $|S_{21@2.44\ GHz}|=-0.49$ dB and FIG. 7C shows the phase response at two frequencies: $S_{21@2.44\ GHz}=0°$ and $S_{21@5.85\ GHz}=-360°$.

Figure 8A:
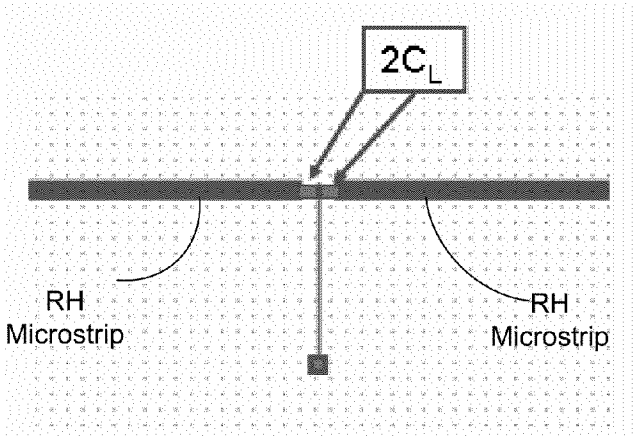
Figure 8B:
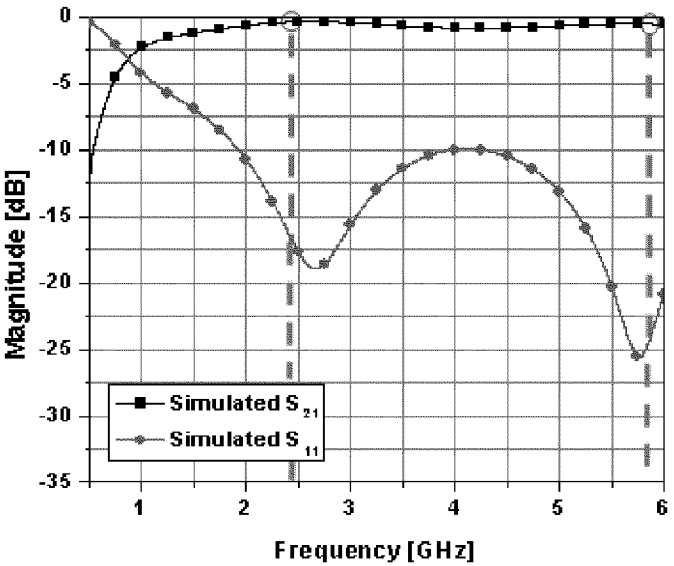
Figure 8C:
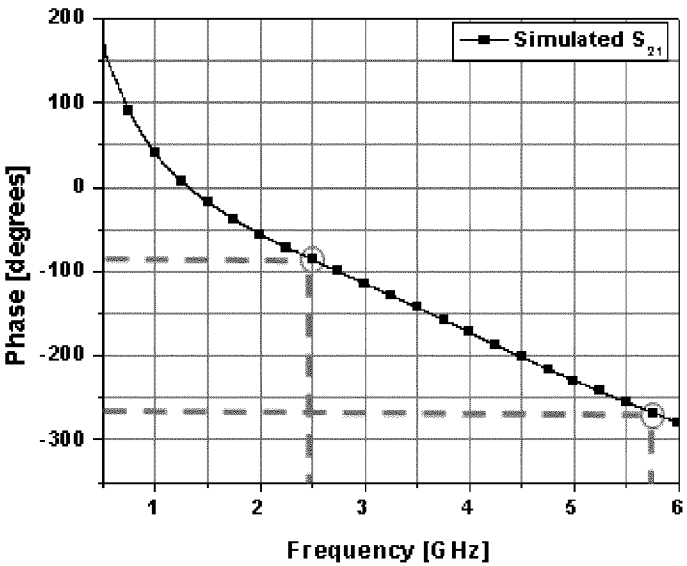

FIG. 8A shows another example of a dual-band CRLH quarter wavelength transformer of a length L at 2 different frequencies, $f_1$=2.44 GHz and $f_2$=5.85 GHz. The calculated values for the unit cell, for the left-hand part are: $L_L$=9.65 nH, $C_L$=1.93 pF and for the right hand part: $C_R$=1.89 pF and $L_R$=9.45 nH. It can be noticed that $$L_R C_L = C_R L_L \text{ and}$$

$$Z_0 = \sqrt{\frac{L_R}{C_R}} = \sqrt{\frac{L_L}{C_L}} = \sqrt{50*50*N}\ \Omega Z_0 = \sqrt{\frac{L_R}{C_R}} = \sqrt{\frac{L_L}{C_L}} = \sqrt{(50*50*N)}\ \Omega, \text{ by}$$

way of example N=2 for this structure, as a result $Z_0$=70.7Ω. FIG. 8B shows the magnitude of this dual-band CRLH TL transformer, with $|S_{21@2.44\ GHz}|=-0.35$ dB and $|S_{21@2.44\ GHz}|=-0.49$ dB. FIG. 8C shows the phase values of this dual-band CRLH TL transformer with $S_{21@2.44\ GHz}=-90°$ and $S_{21@5.85\ GHz}=-270°$.

Figure 9A:
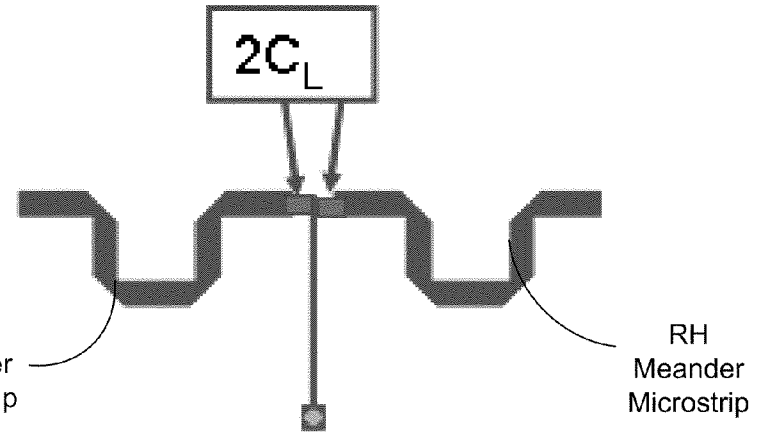
Figure 9B:
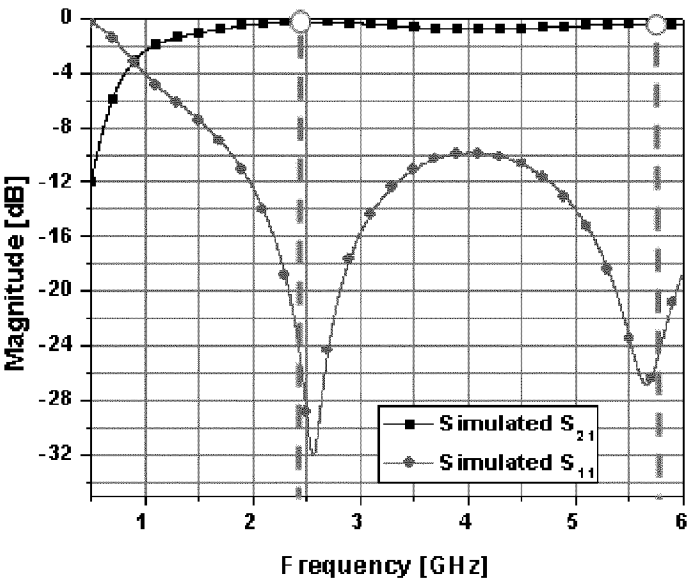
Figure 9C:
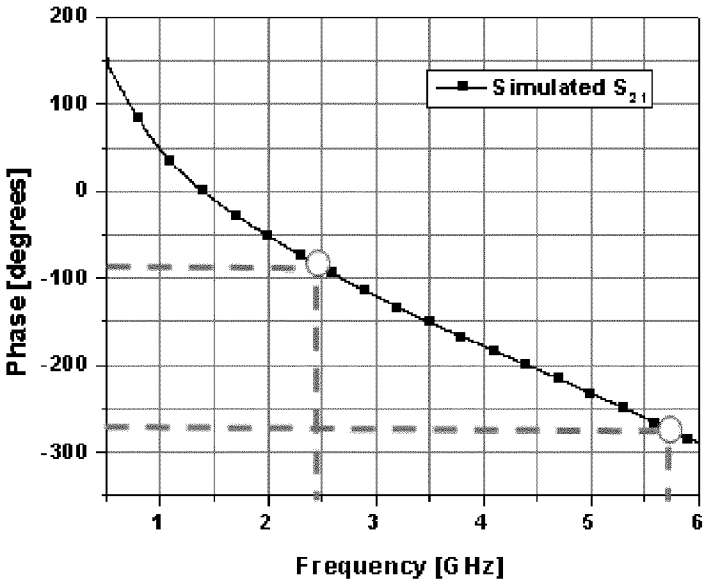

FIG. 9A shows a dual-band CRLH TL quarter wavelength transformer using meander microstrip lines in order to reduce the size. FIG. 9B shows the S-parameters at two different frequencies to be $|S_{21@2.44\ GHz}|=-0.35$ dB and $|S_{21@2.44\ GHz}|=-0.49$ dB. The phases are $S_{21@2.44\ GHz}=-90°$ and $S_{21@5.85\ GHz}=-270°$ as shown in FIG. 9C.

Figure 10:
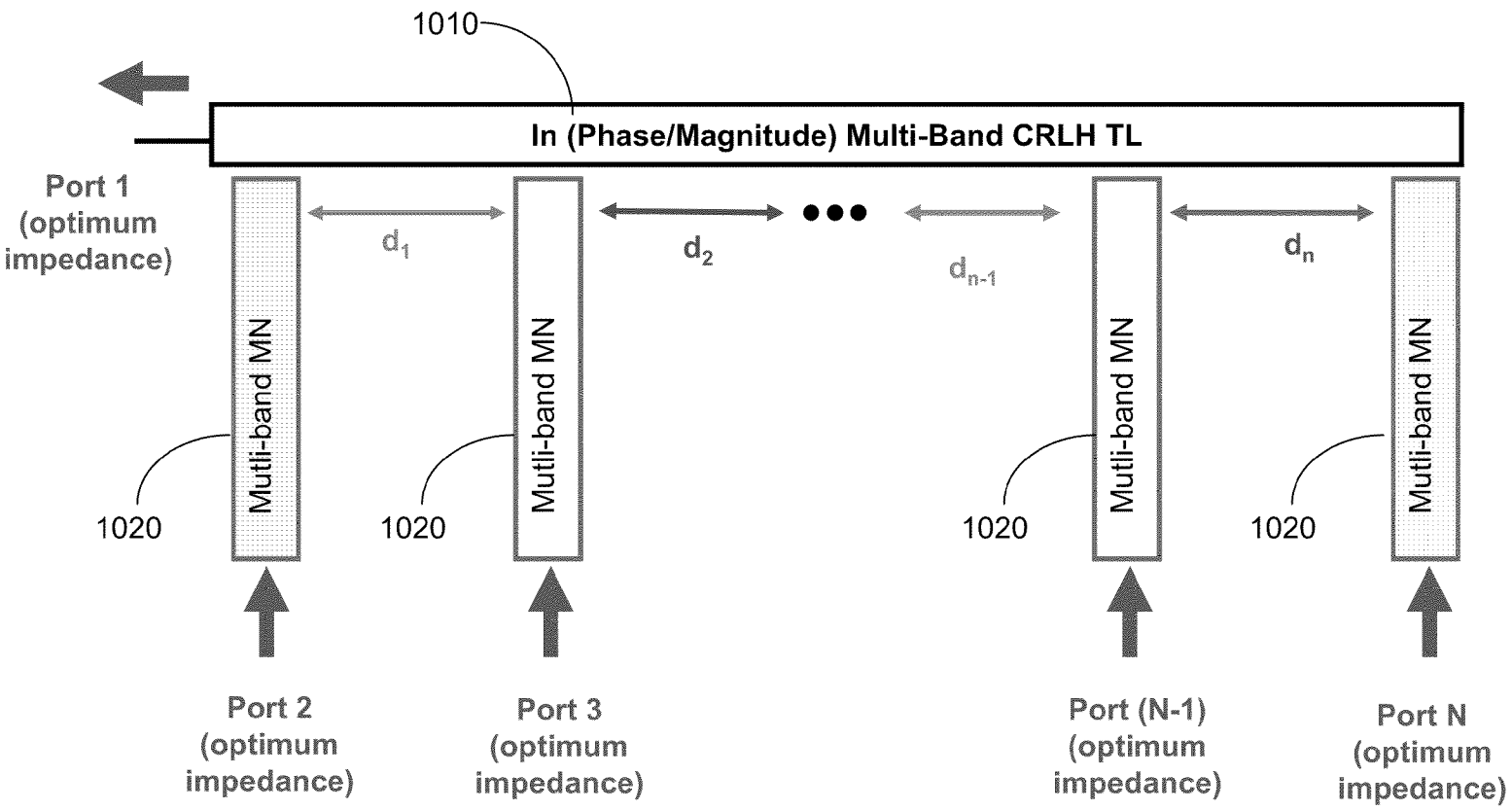
FIGS. 10 through 15B show examples of dual-band and multi-band CRLH transmission line power dividers and combiners.

The above and other dual-band and multi-band CRLH structures can be used to construct N-port dual-band and multi-band CRLH TL serial power combiners and dividers FIG. 10 shows an example of an N-port multi-band CRLH TL serial power combiner or splitter device. This device includes a dual-band or multi-band main CRLH transmission line 1010 structured to exhibit, at least, a first phase at a first signal frequency f1 and a second phase at a second, different signal frequency f2. This main CRLH transmission line 1010 includes two or more CRLH unit cells coupled in series and each CRLH unit cell has a first electrical length that is a multiple of +/−180 degrees at the first signal frequency and a second, different electrical length that is a different multiple of +/−180 degrees at the second signal frequency. Two or more branch CRLH feed lines 1020 are connected at different locations on the CRLH transmission line 1010 to combine signals in the CRLH feed lines 1020 into the CRLH transmission line 1010 or to divide a signal in the CRLH transmission line 1010 into different signals to the CRLH feed lines 1020. Each branch CRLH feed line 1020 includes at least one CRLH unit cell that exhibits a third electrical length that is an odd multiple of +/−90 degrees at the first signal frequency and a fourth, different electrical length that is a different odd multiple of +/−90 degrees at the second signal frequency. As illustrated, each CRLH feed line 1020 is connected to a location between two adjacent CRLH unit cells or at one side of a CRLH unit cell.

Figure 11:
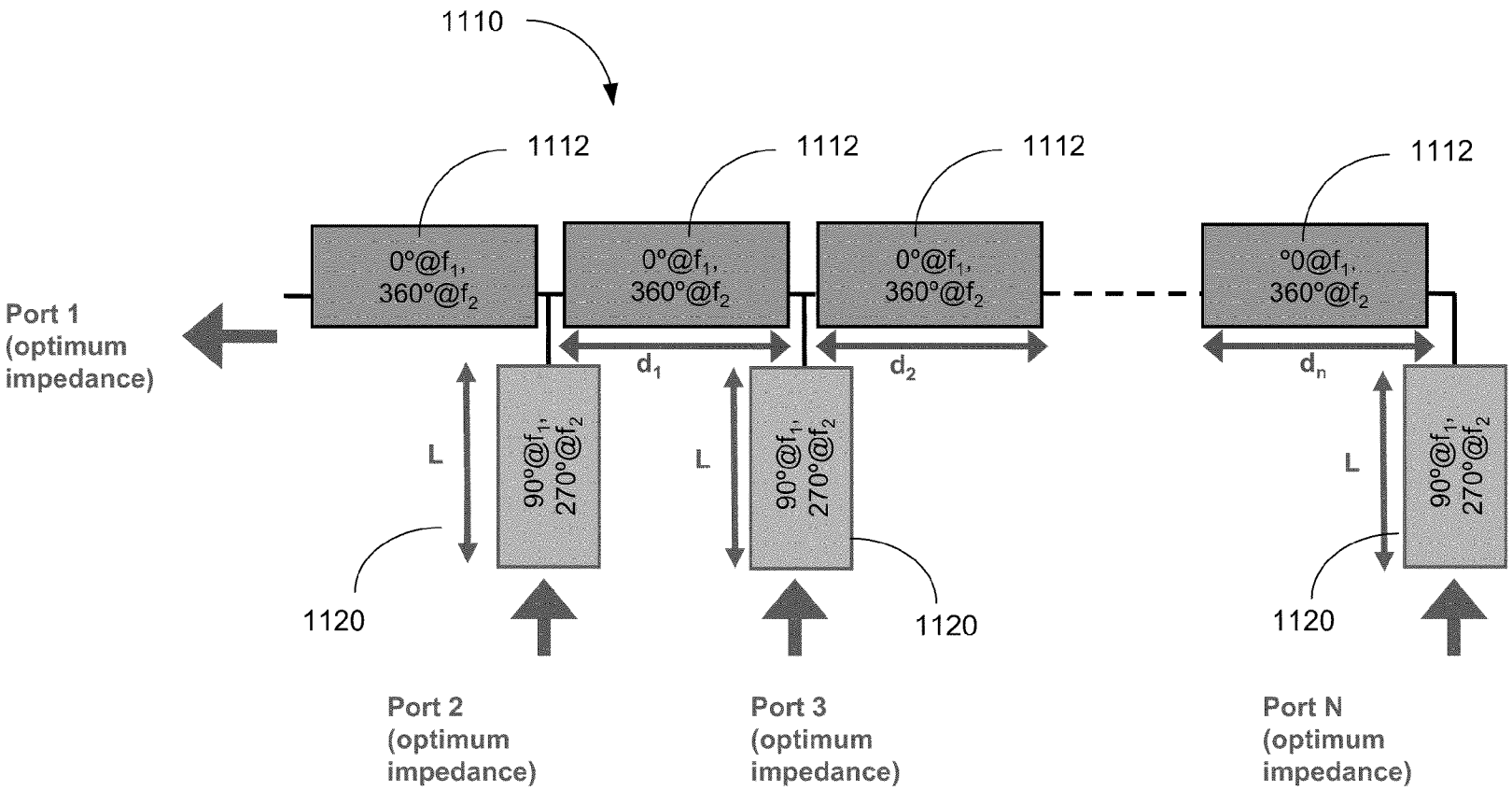

FIG. 11 shows one implementation of a CRLH TL dual-band serial power combiner/divider based on the design in FIG. 10 with the output/input port (port 1-N) matched to 50Ω, while the other ports are matched to optimum impedances. This device includes a dual-band main CRLH transmission line 1110 with dual-band CRLH TL unit cells 1112 and branch CRLH feed lines 1120. Each unit cell 1112 is designed to have an electrical signal length equal to a phase of zero degree at the first signal frequency $f_1$ and a second electrical signal length equal to a phase of 360 degrees at the second signal frequency $f_2$. Each branch CRLH feed line 1120 includes one or more CRLH unit cells and is configured as a dual-band CRLH TL quarter wavelength transformer. The optimum impedances are transformed via the CRLH TL quarter wavelength transformer 1120 of a length L at 2 different frequencies, $f_1$ and $f_2$. In this particular example, each CRLH feed line 1120 is designed to have a phase of 90° (λ/4) [modulo π] at the first signal frequency $f_1$ and a phase of 270° (3λ/4) [modulo π] at the second signal frequency $f_2$. This device has 0 degree phase difference at one frequency and 360° at another frequency between each port.

The two signal frequencies $f_1$ has $f_2$ do not have a harmonic frequency relationship with each other. This feature can be used to comply with frequencies used in various standards such as the 2.4 GHz band and the 5.8 GHz in the Wi-Fi applications. In this configuration, the port position and the port number along the dual-band CRLH TL 1110 can be selected as desired because of the zero degree spacing at $f_1$ and 360° at $f_2$ between each port. For example, the unit cells described in FIGS. 6A and 7A can be used as the unit cells in the CRLH TL 1110 and the unit cells described in FIGS. 8A and 9A can be used in the CRLH feed lines 1120.

Figure 12:
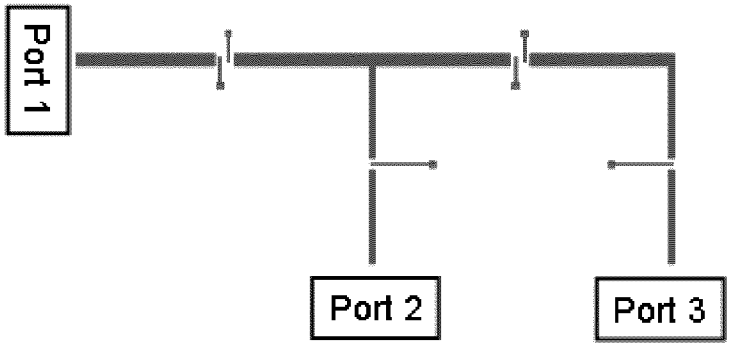
Figure 12:
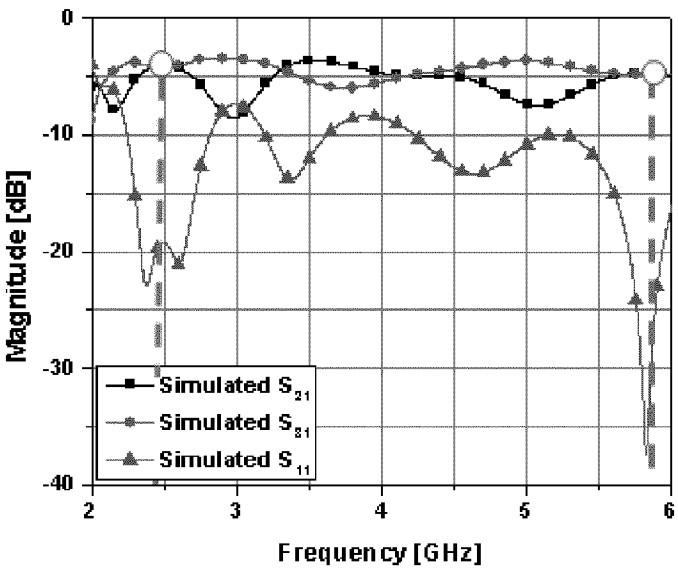
Figure 12:
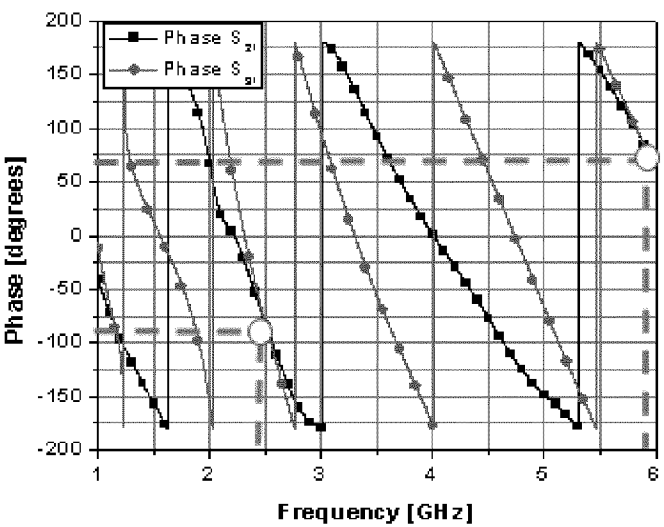

FIG. 12 shows an example of a 3-port CRLH TL dual-band serial power combiner/divider. This example has one input/output port (port 1) in the CRLH TL and two input/output ports via two CRLH feed lines. Each CRLH unit cell in the CRLH TL has an electrical length of zero degree at $f_1$ and an electrical length of 360° at $f_2$ between the ports. FIG. 12 further shows the magnitudes and phase values of S-parameters of this CRLH TL dual-band serial power combiner/divider to be $|S_{21@2.44\ GHz}|=|S_{31@2.44\ GHz}|=-4.2$ dB, $|S_{21@5.85\ GHz}|=|S_{31@5.85\ GHz}|=-4.7$ dB, $S_{21@2.44\ GHz}=S_{31@2.44\ GHz}=-83°$ and $S_{21@5.85\ GHz}=S_{31@5.85\ GHz}=85°$. Therefore the power is evenly split or combined in magnitude and in phase at each port at the two different frequencies.

Figure 13:
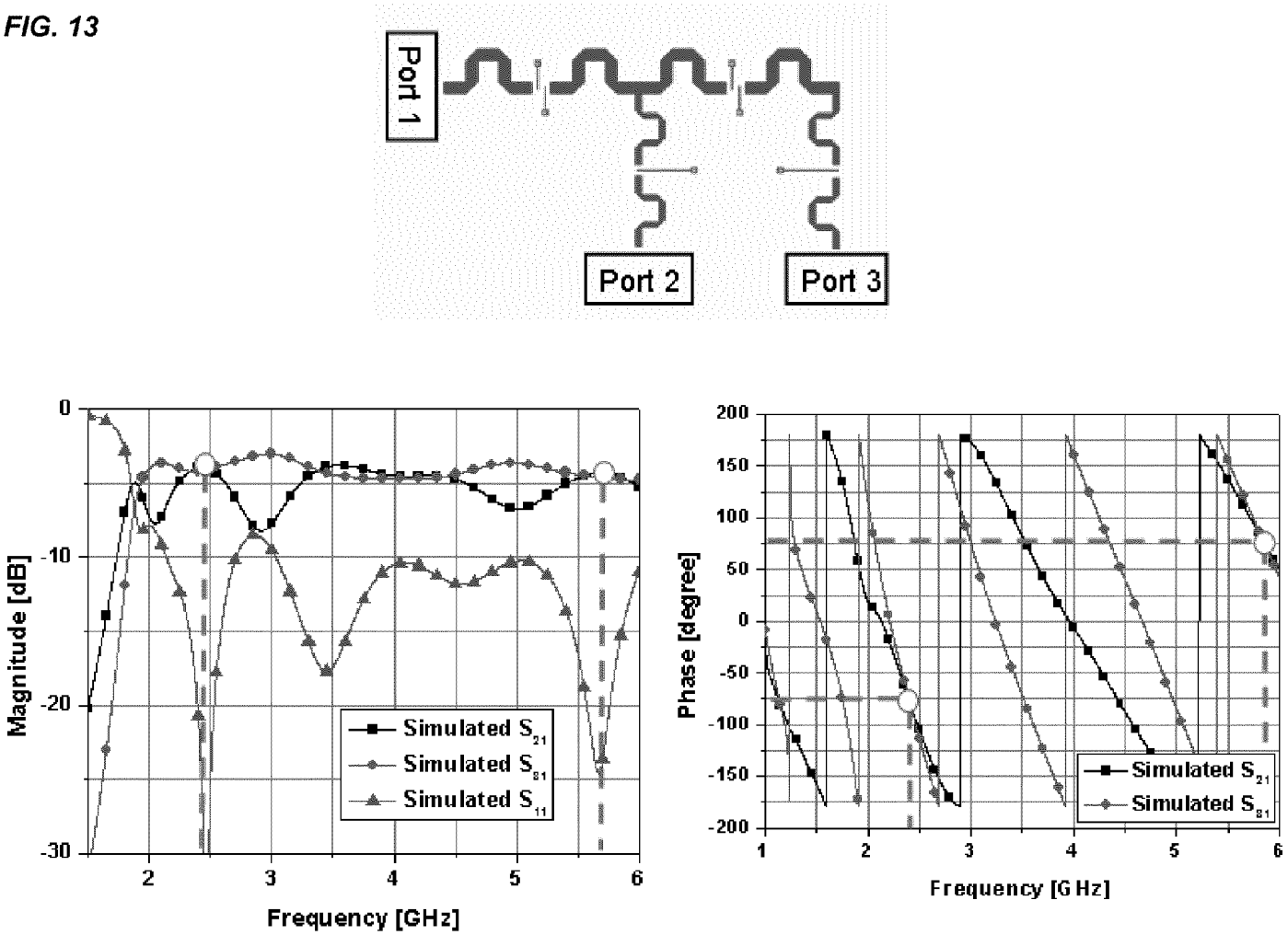

FIG. 13 shows an example of a meander line CRLH TL dual-band serial power combiner/divider. Meander line conductors can be used to replace straight microstrips to reduce the circuit dimension. For example, it is possible to reduce the footprint of a CRLH TL by 1.4 times by using meander lines. The magnitudes of this meander line CRLH TL dual-band serial power combiner/divider are $|S_{21@2.44\ GHz}|=|S_{31@2.44\ GHz}|=-4.08$ dB, and $|S_{21@5.85\ GHz}|=|S_{31@5.85\ GHz}|=-4.6$ dB. The phases of this meander line CRLH TL dual-band serial power combiner/divider are $S_{21@2.44\ GHz}=S_{31@2.44\ GHz}=-88°$ and $S_{21@5.85\ GHz}=S_{31@5.85\ GHz}=68°$. Therefore, the power is evenly split or combined at each port at two different frequencies.

Figure 14A:
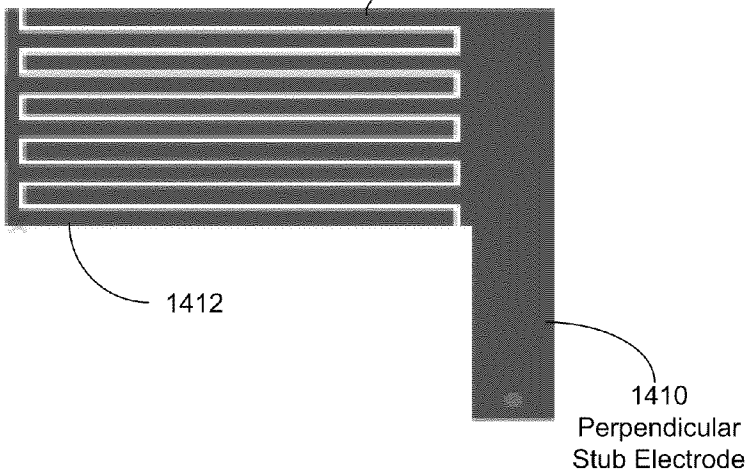
Figure 14B:
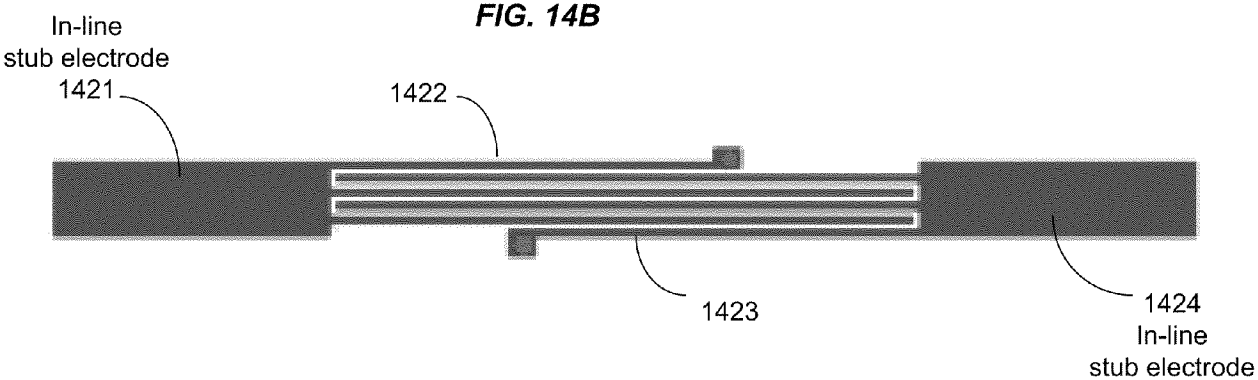

FIGS. 14A and 14B show two examples of distributed CRLH unit cells. In FIG. 14A, the distributed CRLH unit cell includes a first set of connected electrode digits 1411 and a second set of connected electrode digits 1412. These two sets of electrode digits are separated without direct contact and are spatially interleaved to provide electromagnetic coupling with one another. A perpendicular shorted stub electrode 1410 is connected to the first set of connected electrode digits 1411 and protrudes along a direction that is perpendicular to the electrode digits 1411 and 1412. FIG. 14B shows another design of a distributed CRLH unit cell with two sets of connected electrode digits 1422 and 1423. The connected electrode digits 1422 are connected to a first in-line shorted stub electrode 1421 along the electrode digits 1422 and 1423 and the connected electrode digits 1423 are connected to a second in-line shorted stub electrode 1424 along the electrode digits 1422 and 1423.

Figure 15A:
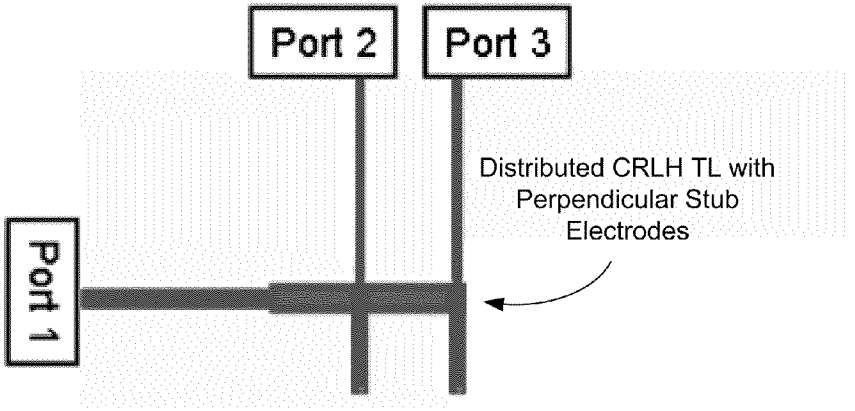
Figure 15B:
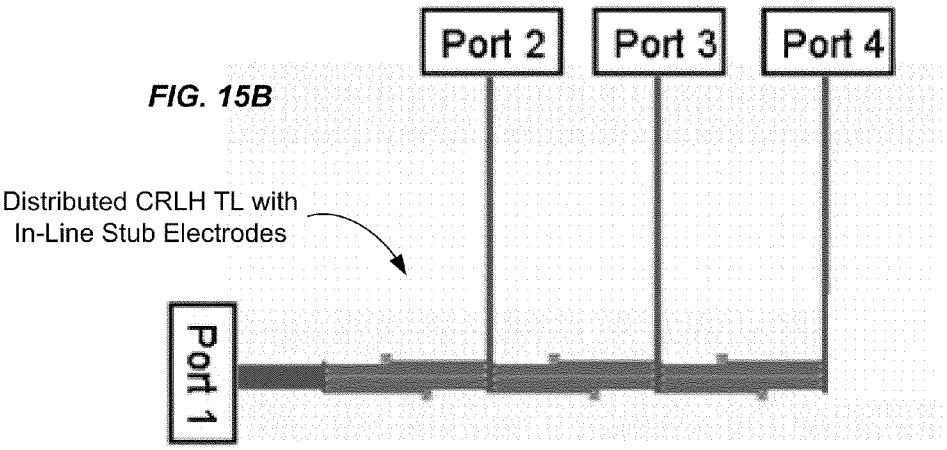

FIGS. 15A and 15B show two examples of dual-band or multi-band CRLH TL power divider or combiner based on the distributed CRLH unit cells in FIGS. 14A and 14B. In FIG. 15A, a 3-port dual-band or multi-band CRLH TL power divider or combiner is shown to include two unit cells in FIG. 14A with perpendicular shorted stub electrodes. In FIG. 15B, a 4-port dual-band or multi-band CRLH TL power divider or combiner is shown to include three unit cells in FIG. 14B with in-line shorted stub electrodes.

Figure 16:
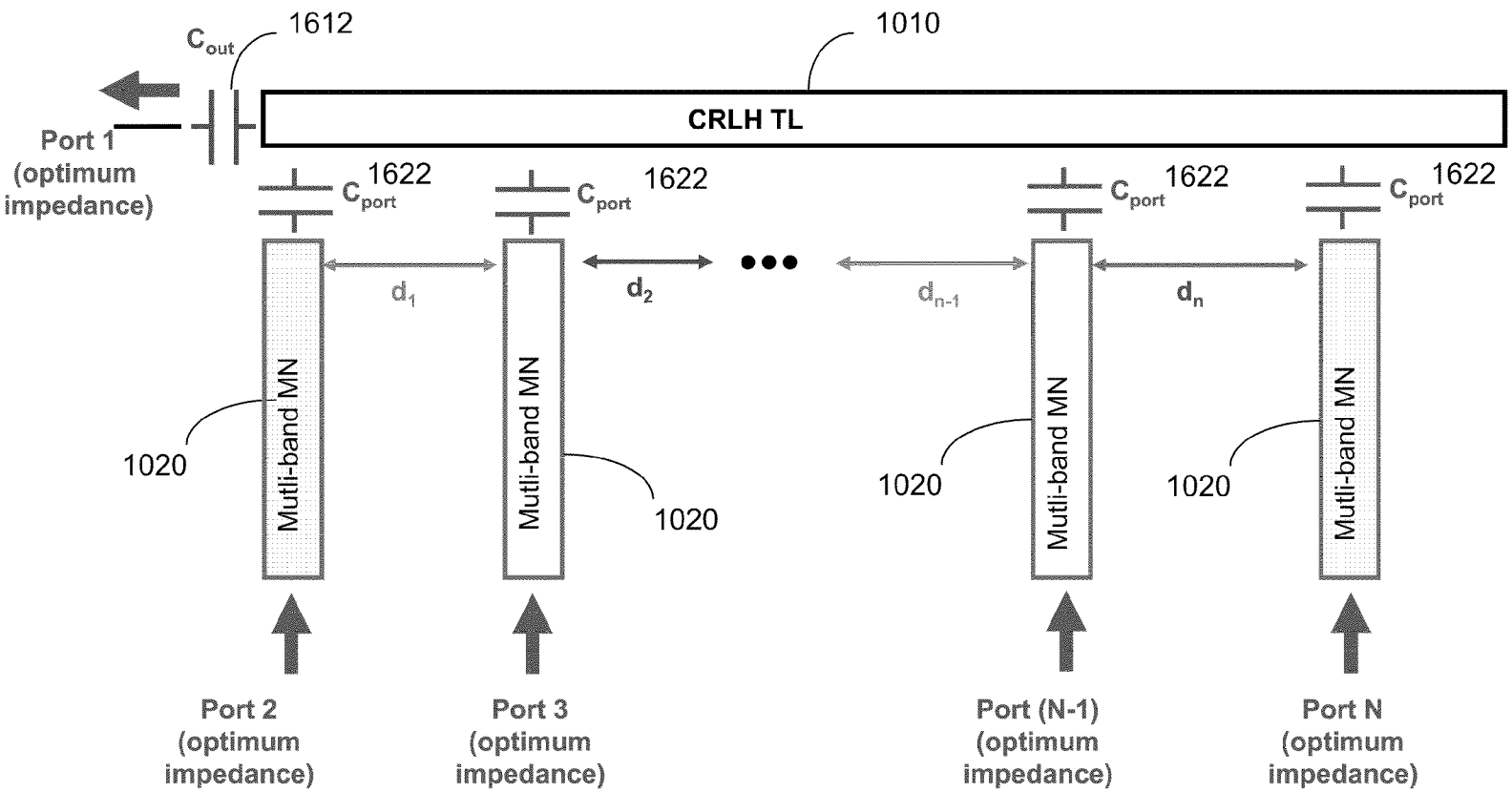
FIGS. 16 through 20B show examples of dual-band and multi-band CRLH transmission line resonator power dividers and combiners.

The above described multi-band CRLH TL power dividers or combiners can be used to construct multi-band CRLH TL power dividers or combiners in resonator configurations. FIG. 16 shows one example of a dual-band or multi-band CRLH TL power divider or combiner in a resonator configuration based on the design in FIG. 10. Different from the device in FIG. 10, an input/output capacitor 1612 is coupled at the port 1 at one end of the main CRLH TL 1010 and each branch CRLH feed line 1020 is capacitively coupled to the CRLH TL 1010 via a port capacitor 1622.

Figure 17:
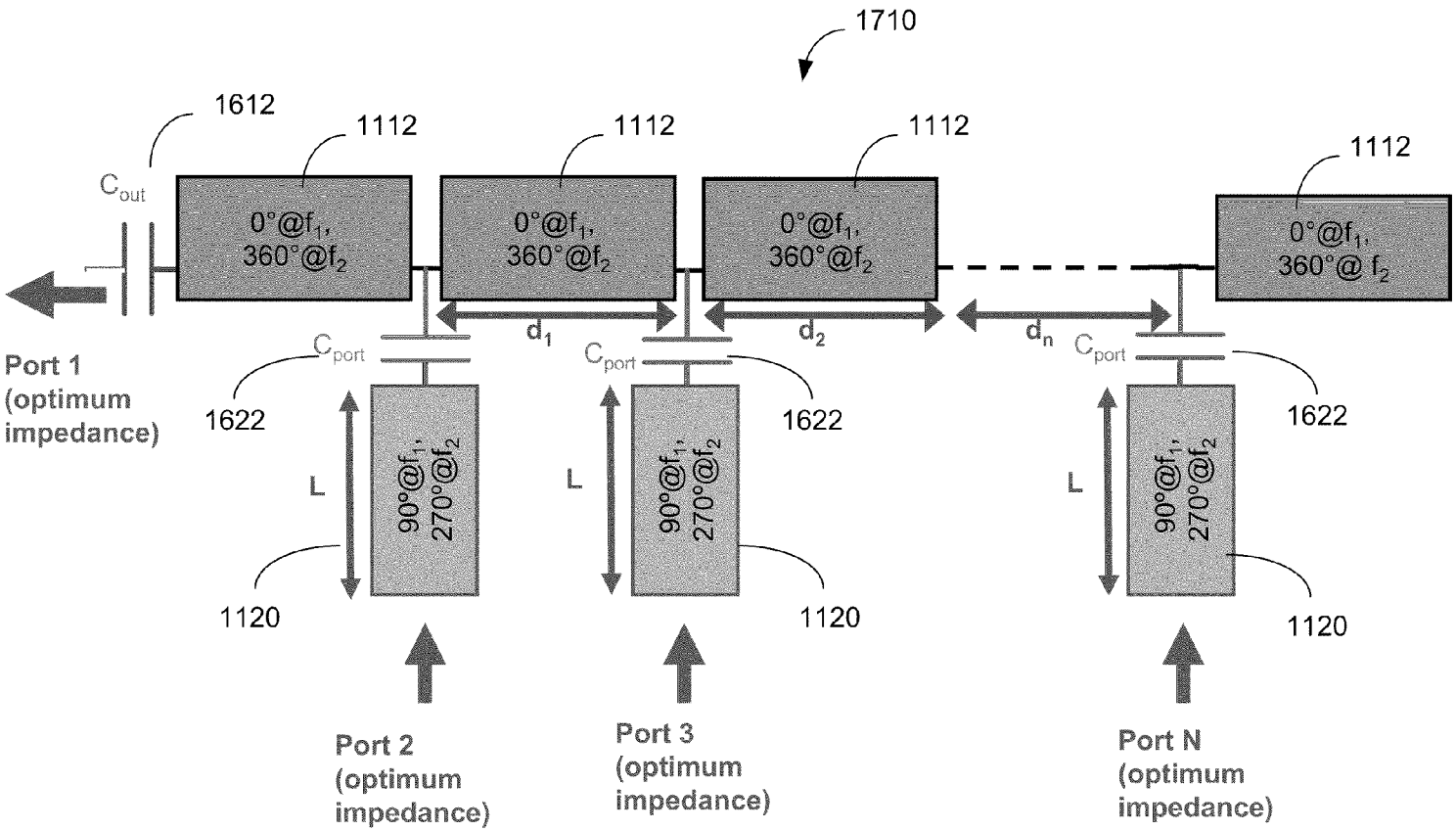

FIG. 17 illustrates a dual-band resonator serial power combiner/divider based on the designs in FIGS. 10, 11 and 16 with an electrical length of zero degree at $f_1$ and 360° at $f_2$. This dual-band CRLH TL performs as a resonator by being terminated with an open ended. The output/input ports (port 1-N) can be matched to 50Ω, while the other ports are match to optimum impedances. These optimum impedances are transformed via a CRLH TL quarter wavelength transformer of length L at 2 different frequencies, $f_1$ and $f_2$. By way of example $f_1$ has a phase of 90° (λ/4) [modulo π] while $f_2$ has a phase of 270° (3λ/4) [modulo π].

Figure 18:
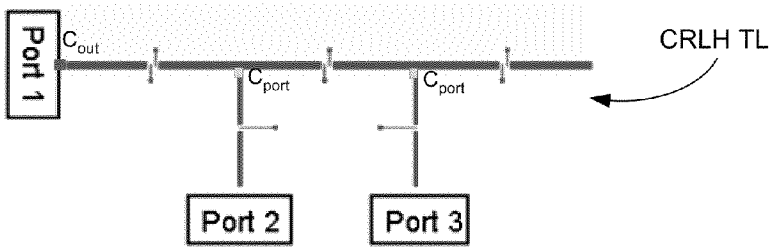
Figure 18:
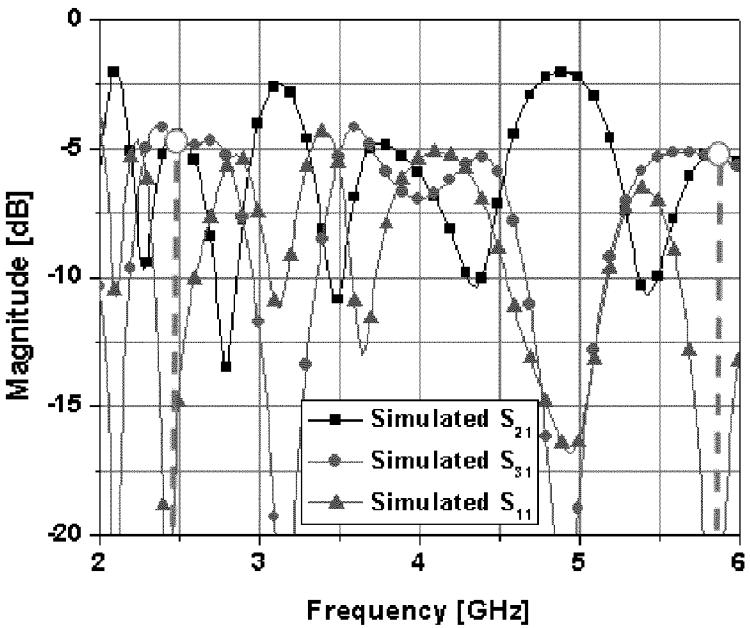
Figure 18:
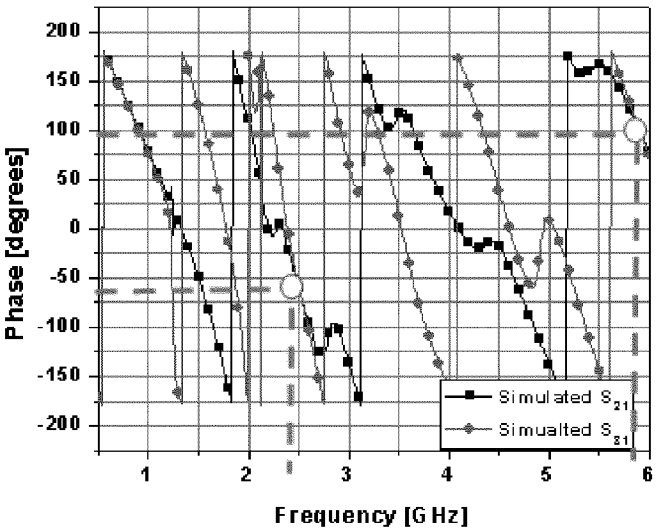

FIG. 18 shows an example of the CRLH TL dual-band resonator serial power combiner/divider with one open ended unit cell. The values of the port or coupling capacitors to tap the power to the dual-band CRLH-TL are 1.1 pF, whereas the value of the input/output coupling capacitor at the output port of the CRLH TL dual-band resonator serial power combiner/divider is 9 pF. The magnitudes of S-parameters are $|S_{21@2.44\ GHz}|=|S_{31@2.44\ GHz}|=-4.3$ dB, and $|S_{21@5.85\ GHz}|=|S_{31@5.85\ GHz}|=-5.2$ dB. The phase values of the S-parameters are $S_{21@2.44\ GHz}=S_{31@2.44\ GHz}=-53°$ and $S_{21@5.85\ GHz}=S_{31@5.85\ GHz}=117°$.

Figure 19:
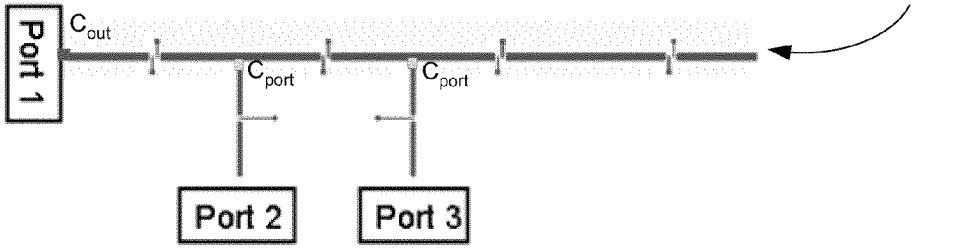
Figure 19:
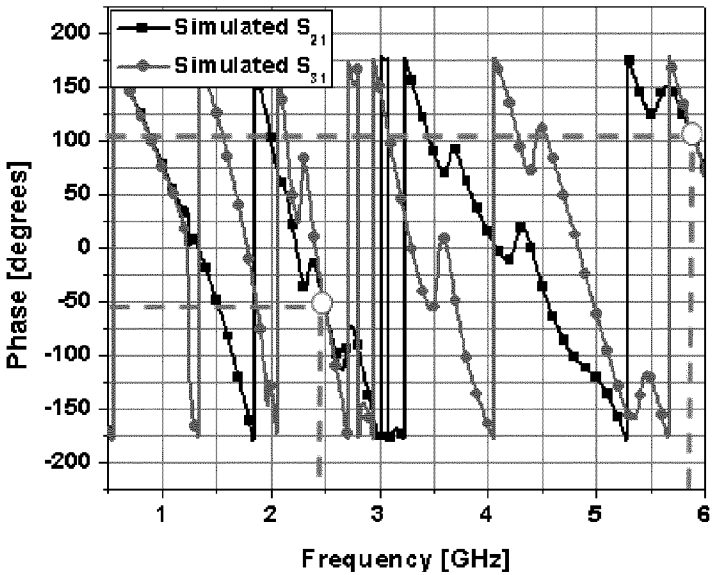
Figure 19:
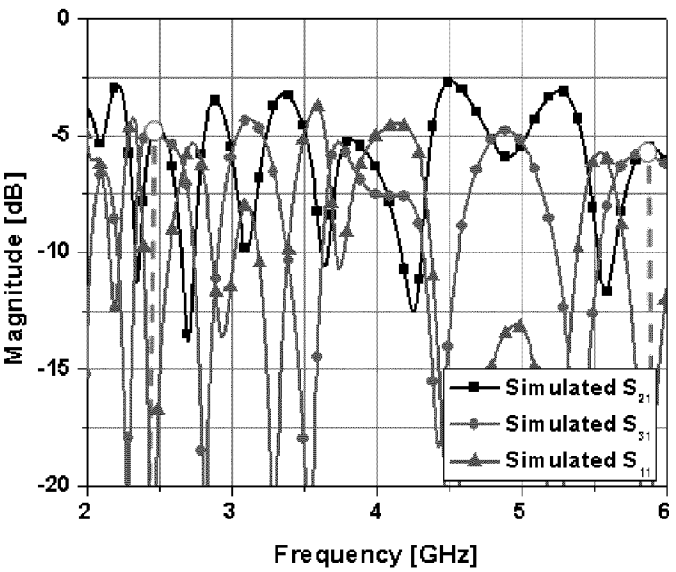

FIG. 19 shows an example of a CRLH TL dual-band resonator serial power combiner/divider. This CRLH TL dual-band resonator serial power combiner/divider is terminated by two unit cells open ended. The magnitudes and phase values of the S-parameters are $|S_{21@2.44\ GHz}|=|S_{31@2.44\ GHz}|=-4.7$ dB, and $|S_{21@5.85\ GHz}|=|S_{31@5.85\ GHz}|=-5.4$ dB; and $S_{21@2.44\ GHz}=S_{31@2.44\ GHz}=-53°$ and $S_{21@5.85\ GHz}=S_{31@5.85\ GHz}=117°$. This structure has higher loss than the structure in FIG. 18 and this higher loss can be caused by its longer length by one unit cell. The losses come from the substrate FR4 used and from the lumped elements. It is possible to minimize these losses by using a substrate with a lower loss tangent and by choosing better lumped elements or by using distributed lines. It is also possible to use meander lines to minimize the footprint of this structure.

Figure 20A:
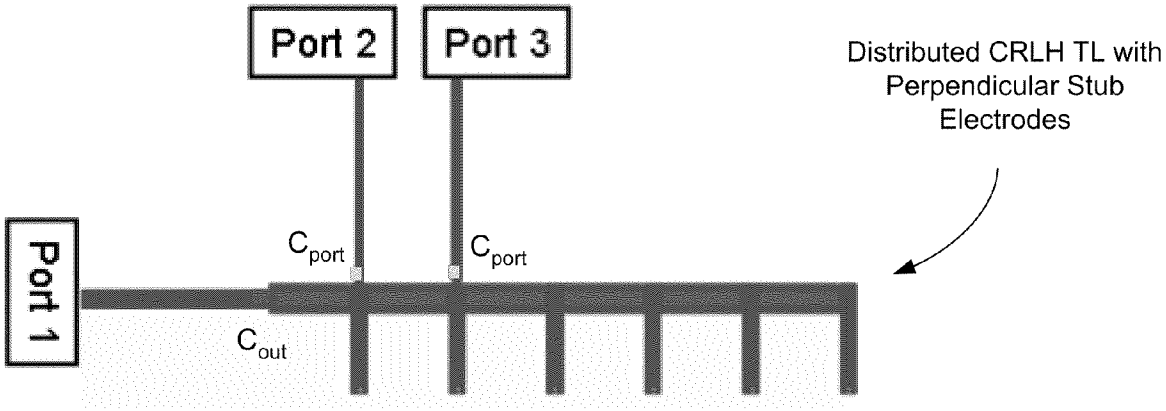
Figure 20B:
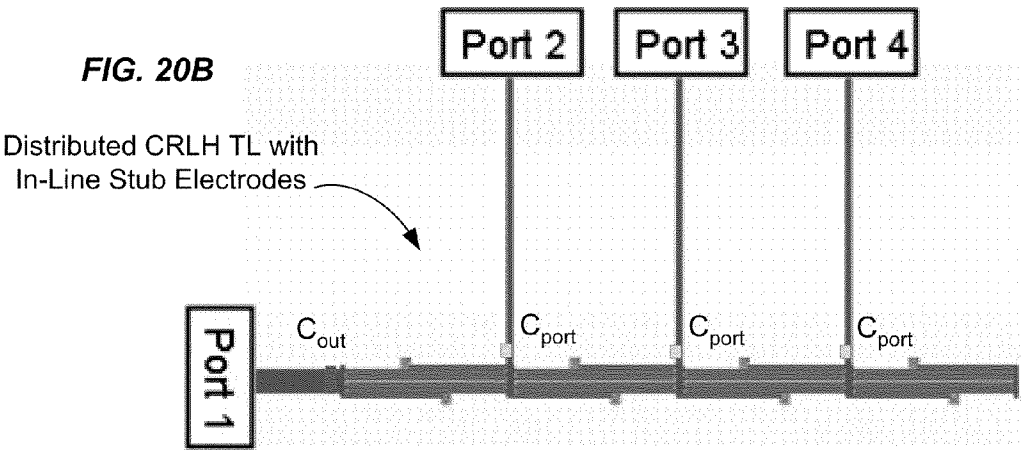

FIGS. 20A and 20B show two examples of dual-band or multi-band CRLH TL resonator power divider or combiner based on the distributed CRLH unit cells in FIGS. 14A and 14B. In FIG. 20A, a 3-port dual-band or multi-band CRLH TL resonator power divider or combiner is shown to include six unit cells in FIG. 14A with perpendicular shorted stub electrodes. The TL is terminated by four unit cells open ended. In FIG. 20B, a 4-port dual-band or multi-band CRLH TL resonator power divider or combiner is shown to include four unit cells in FIG. 14B with in-line shorted stub electrodes and the TL is terminated by one unit cell open ended.

Figure 21A:
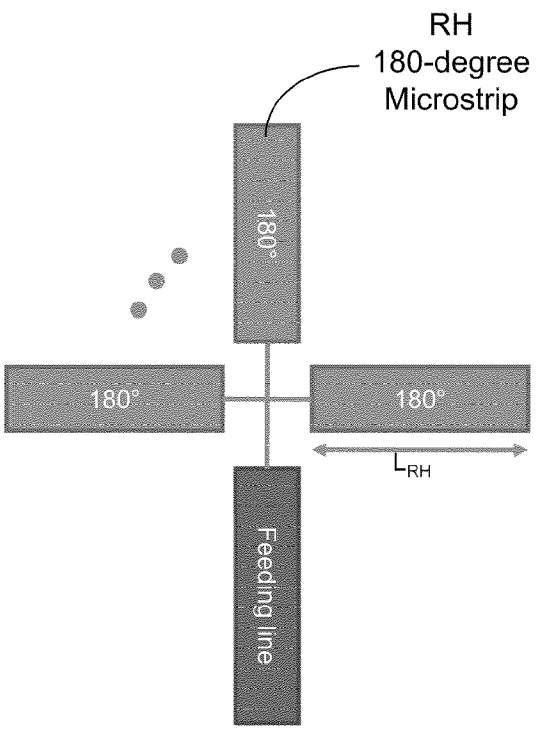
FIG. 21A shows an example of a RH microstrip radial power combiner and divider device.

A power combiner or divider can be structured in a radial configuration. FIG. 21A shows an example of a conventional single-band radial power combiner/divider formed by using conventional RH microstrips with an electrical length of 180° at the signal frequency. A feed line is connected to terminals of the RH microstrips to combine power from the microstrips to output a combined signal or to distribute power in a signal received at the feed line into signals directed to the microstrips. The lower limit of the physical size of such a power combiner or divider is limited by the length of each microstrip with an electrical length of 180 degrees.

Figure 21B:
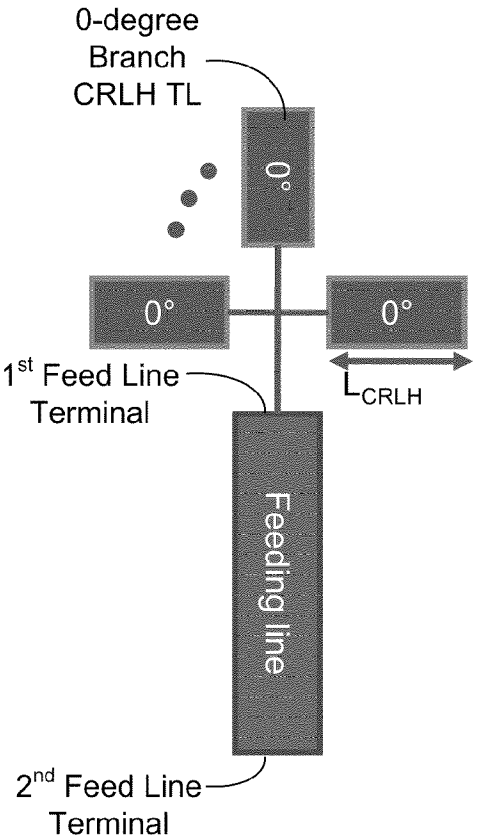
FIGS. 21B through 25C show examples of CRLH radial power combiner and divider devices.

FIG. 21B shows a single-band N-port CRLH TL radial power combiner/divider. This device includes branch CRLH transmission lines each formed on the substrate to have an electrical length that is either a zero degree or a multiple of +/−180 degrees at an operating signal frequency and a main feedline. Each branch CRLH transmission line has a first terminal that is connected to first terminals of other branch CRLH TLs and a second terminal that is open ended or coupled to an electrical load. A main signal feed line is formed on the substrate to include a first feed line terminal electrically coupled to the first terminals of the branch CRLH transmission lines and a second feed line terminal that is open ended or coupled to an electrical load. This main feed line is to receive and combine power from the branch CRLH transmission lines at the first feed line terminal to output a combined signal at the second feed line terminal or to distribute power in a signal received at the second feed line terminal into signals directed to the first terminals of the branch CRLH transmission lines for output at the respect second terminals of the branch CRLH transmission lines, respectively. Notably, each CRLH TL in FIG. 21B can be configured to have a phase value of zero degree at the operating signal frequency to form a compact N-port CRLH TL radial power combiner/divider. The size of this 0° CRLH TL is only limited by its implementation using lumped elements, distributed lines or a "vertical" configuration such as MIMs.

Figure 21C:
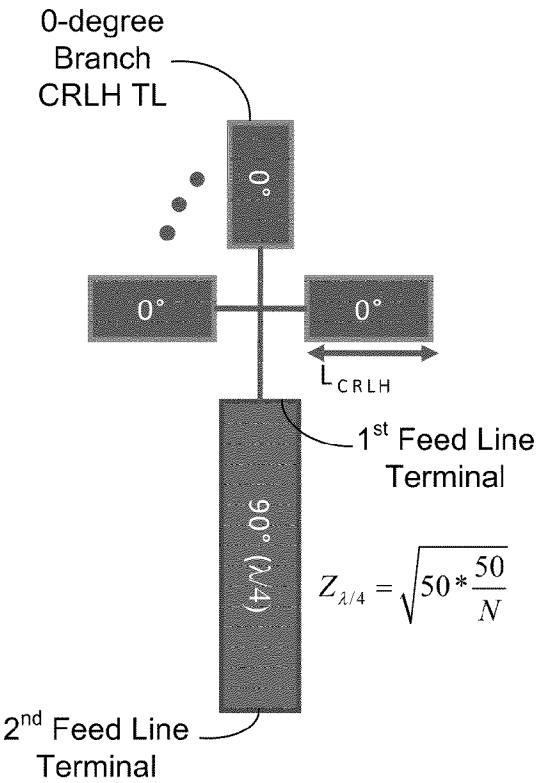

The main feedline can be a conventional RH feedline or a CRLH feedline. The conventional feedline is optimal when a power combiner is used in a switch configuration, where one branch line is connected to the main feedline and the rest of plural branches are disconnected. The main CRLH feedline is optimal when the branch CRLH lines is simultaneously connected. FIG. 21C shows an example where the main CRLH transmission line is structured to have an electrical length that corresponds to a phase of 90 degrees (i.e., a quarter wavelength) or an odd multiple of 90 degrees at the operating signal frequency. The impedance of the main feedline can be set to $$Z_{\lambda/4} = \sqrt{50 * \frac{50}{N}}$$

We simulated, fabricated and measured performance parameters of CRLH TL zero degree compact single band radial power combiners and dividers based on the above design. All single band radial power combiners/dividers presented are using the same feeding line length of 20 mm in order to compare the device performance. The length of the feeding line can be selected based on the specific need in each application.

Figure 22A:
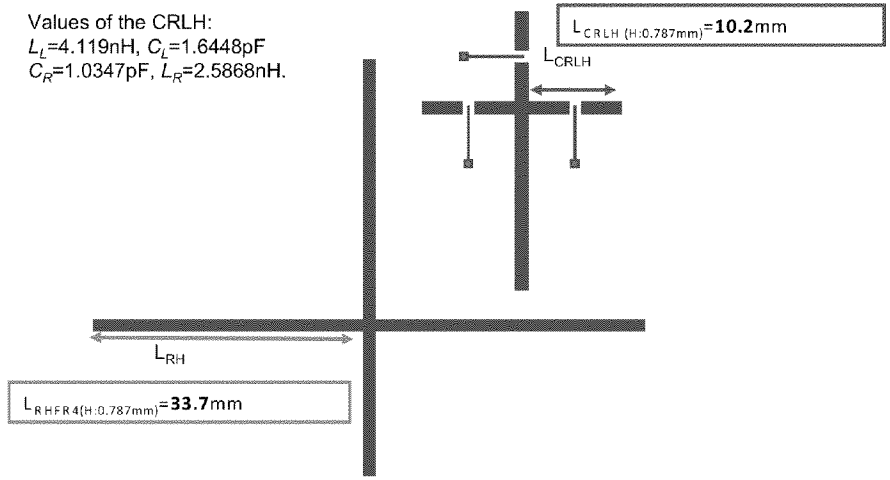

FIG. 22A shows an example of a 4-port RH 180-degree microstrip radial power combiner/divider device and an example of a 4-port CRLH 0-degree radial power combiner/divider device. The ratio of the dimensions of the two devices is 3:1. The physical electrical length of a 180-degree microstrip line using the substrate FR4 is 33.7 mm. By way of example, the calculated values for the 0° CRLH TL presented are: $C_L$=1.5 pF, implemented with lumped capacitors and $L_L$=3.75 nH implemented with a shorted stub. For the right-hand part of the chosen values are: $L_R$=2.5 nH and $C_R$=1 pF, these values were implemented by using conventional microstrip, by way of example on the substrate FR4 ($\in_r$=4.4, H=31 mil).

Figure 22C:
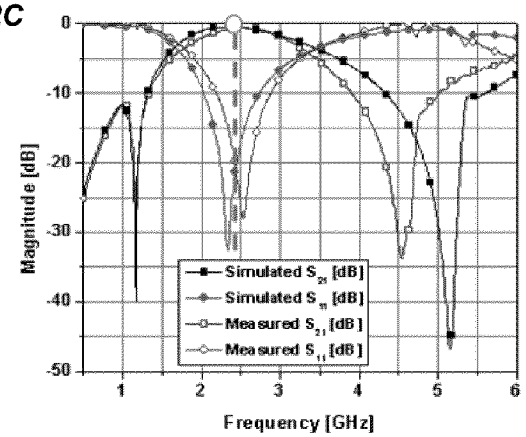
Figure 22B:
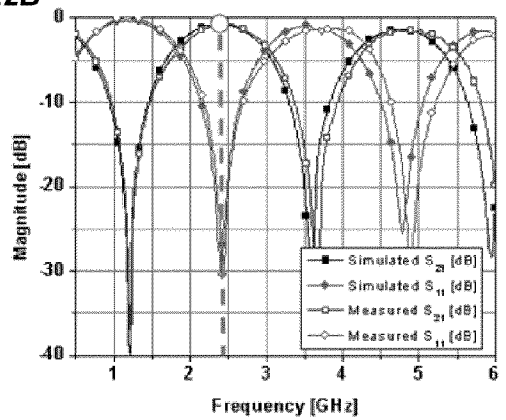

FIG. 22B shows the simulated and measured magnitudes of the S-parameters for the 3-port RH 180-degree microstrip radial power combiner and divider device. $|S_{21@2.425\ GHz}|$=−0.631 dB and $|S_{11@2.425\ GHz}|$=−30.391 dB. FIG. 22C shows simulated and measured magnitudes of the S-parameters for 4 ports CRLH TL zero degree Compact single band radial power combiner/divider, with $|S_{21@2.528\ GHz}|$=−0.603 dB and $|S_{11@2.528\ GHz}|$=−28.027 dB. There is a slight shift in the frequency between the simulated and measured results, which may be attributed to the lumped elements used.

Figure 23B:
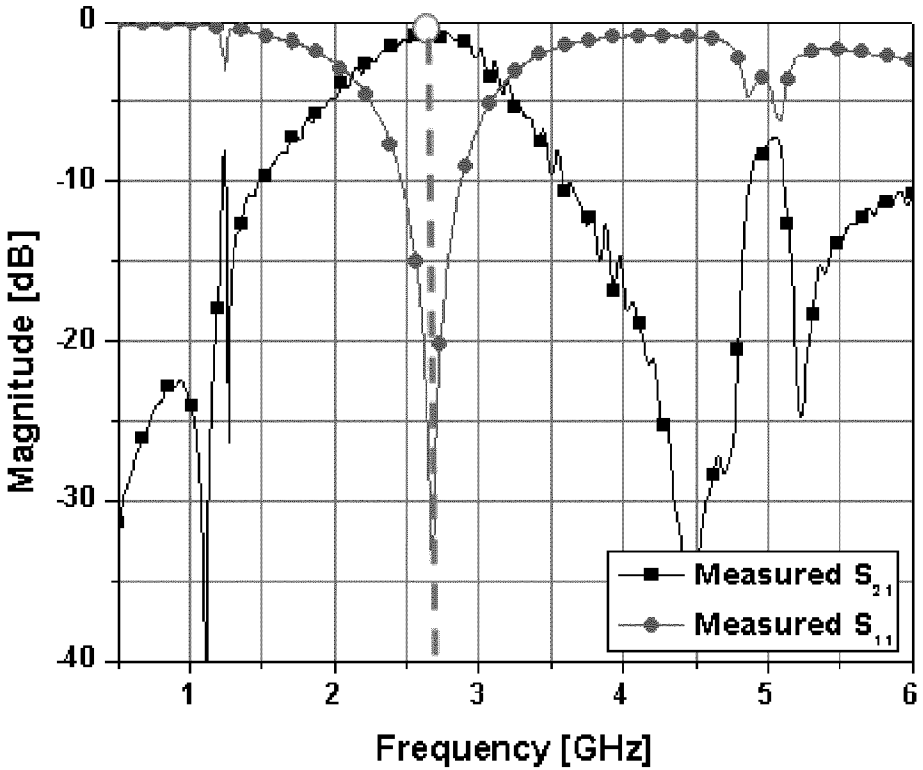
Figure 23A:
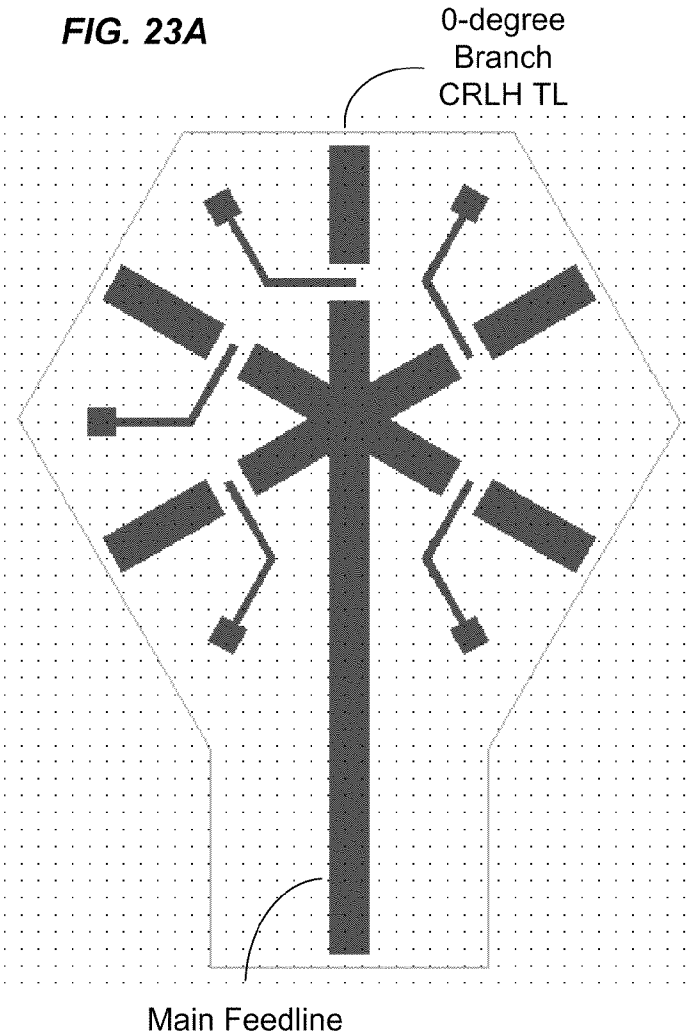

FIG. 23A shows an example of a 5-port CRLH TL zero degree Compact single band radial power combiner/divider. This 5-port device uses the same 0° CRLH TL unit cell as the 4-port CRLH TL zero degree compact single band radial power combiner/divider. FIG. 23B shows the measured magnitudes of the S-parameters, with $|S_{21@2.665\ GHz}|$=−0.700 dB and $|S_{11@2.665\ GHz}|$=−33.84373 dB with a phase of 0° @2.665 GHz.

Figure 24A:
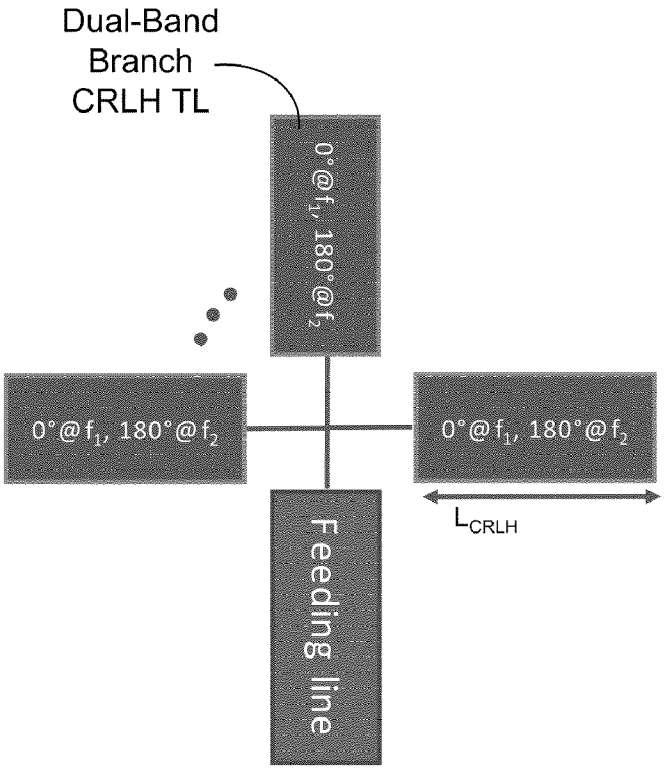
Figure 24B:
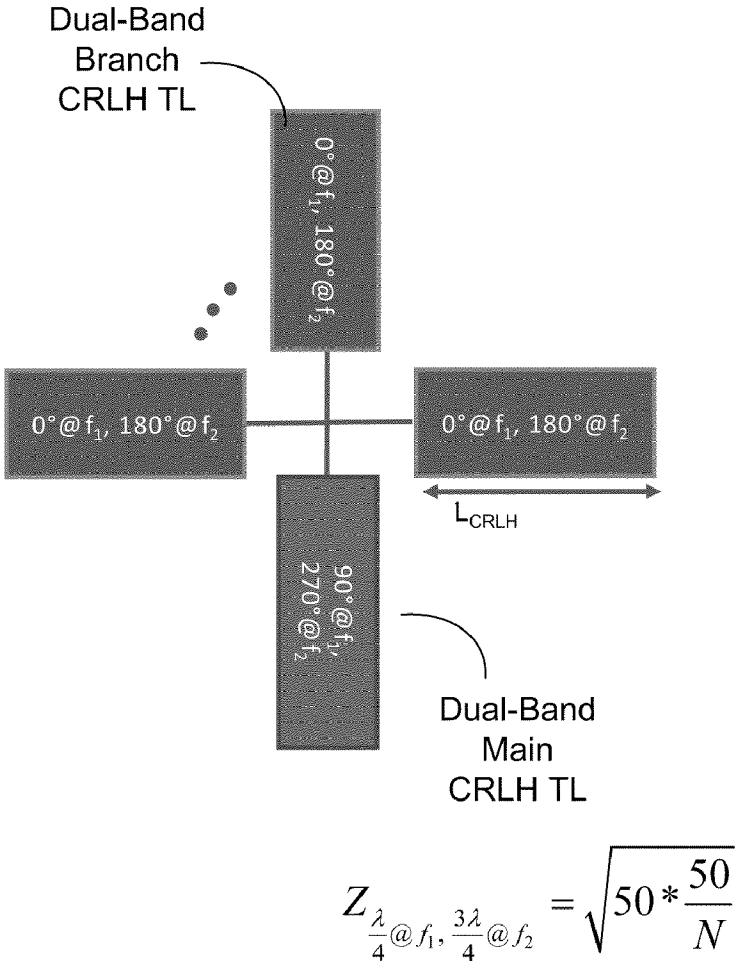

The above single-band radial CRLH devices can be configured as dual-band and multi-band devices by replacing a single-band CRLH TL component with a respective dual-band or multi-band CRLH TL component. FIG. 24A shows an example of a multi-band radial power combiner/divider. As a specific example, the phase at one frequency $f_1$ can be chosen to be 0 degree and the phase at another frequency $f_2$ can be chosen to be 180 degrees. The main feedline can be a conventional RH feedline or a CRLH feedline. The conventional feedline is optimal when a power combiner is used in a switch configuration, where one branch line is connected to the main feedline and the rest of plural branches are disconnected. The main CRLH feedline is optimal when plurality of the branch CRLH lines is simultaneously connected. FIG. 24B shows the use of a dual-band CRLH TL as the main feedline. The main CRLH transmission line is structured to have a third electrical length that corresponds to a phase of 90 degrees or an odd multiple of 90 degrees at the first signal frequency and a fourth electrical length that is different from the third electrical length and corresponds to a phase of 90 degrees or an odd multiple of 90 degrees at the second signal frequency. The impedance of the main CRLH TL is $$Z_{\frac{\lambda}{4}@f_1, \frac{3\lambda}{4}@f_2} = \sqrt{50 * \frac{50}{N}}$$

Figure 25B:
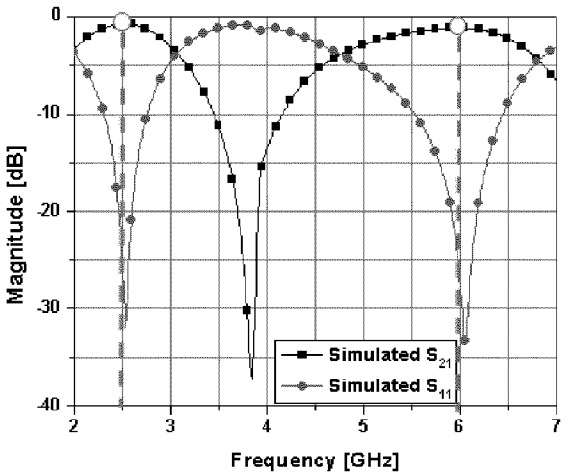
Figure 25C:
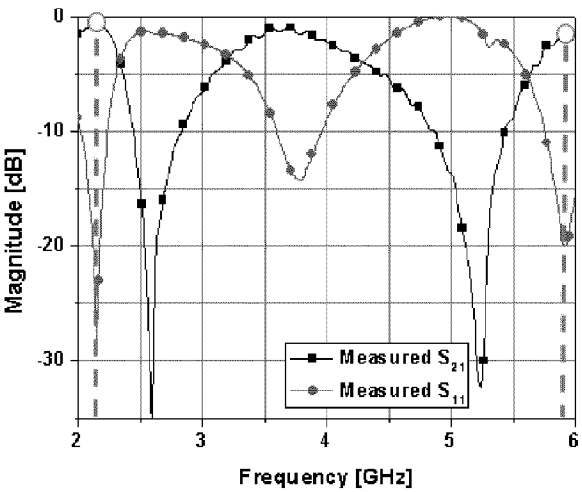
Figure 25A:
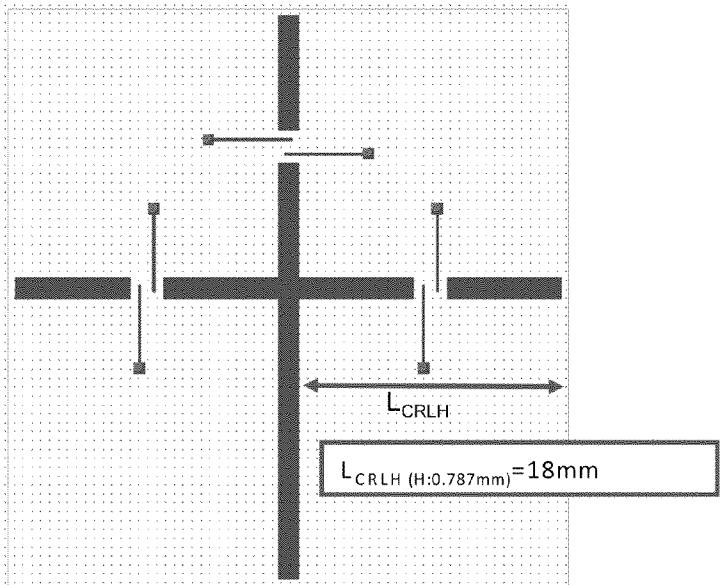

FIG. 25A shows an example of a 3-port CRLH TL dual-band radial power combiner/divider. The feeding line at port 1 is 20 mm. The total length of one arm of the N-port CRLH TL dual-band radial power combiner/divider is 18 mm, which is still smaller and almost half of the size of a conventional microstrip single-band ($L_{180°}$=33.7 mm). By way of example, the RH portion of the dual-band CRLH TL uses the substrate FR4 ($\in_r$=4.4, H=31 mil) to model the values calculated $C_R$=1 pF and $L_R$=2.5 nH. By way of example the LH portion is implemented by using lumped elements with values of: $C_L$=1.6 pF and $L_L$=4 nH.

FIG. 25B shows the simulated S-parameters at 2.44 GHz: $|S_{11@2.44\ GHz}|$=−31.86 dB and $|S_{21@2.44\ GHz}|$=−0.71 dB with a phase of $S_{21@2\ 44\ GHz}$=0°. At 5.85 GHz: $|S_{11@5.85\ GHz}|$=−33.34 dB and $|S_{21@5.85\ GHz}|$=−1.16 dB, $S_{21@5.85\ GHz}$=−180°. FIG. 25C shows the measured S-parameters of the 4-port zero degree CRLH TL dual-band radial power combiner/divider, with $|S_{21@2.15\ GHz}|$=−0.786 dB and $|S_{11@2.15\ GHz}|$=−27.2 dB. At 5.89 GHz: $|S_{11@5.89\ GHz}|$=−33.34 dB and $|S_{21}|$=−1.16 dB, $S_{21}$=−180°. The losses observed are mainly due to the losses of the substrate FR4 and can be reduced by using a substrate with less loss and better lumped elements. Another example of implementation of the N-port CRLH TL multi-band radial power combiner/divider is to use a "Vertical" architecture configuration or distributed lines. This N-port CRLH TL dual-band radial power combiner/divider presented has the advantages to be dual-band and to be smaller than a conventional microstrip radial power combiner/divider. This N-port CRLH TL dual-band radial power combiner/divider can be used in dual-band configurations such as Wi-Fi, WiMAX, cellular/PCS frequency, GSM bands, with board-space limited.

While this specification contains many specifics, these should not be construed as limitations on the scope of an invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination.

Only a few implementations are disclosed. However, it is understood that variations and enhancements may be made.

What is claimed is:

1. A power transforming device, comprising:

a plurality of transmission lines, wherein at least one of the plurality of transmission lines is a composite right and left handed (CRLH)-based structure; and a port coupled to the plurality of transmission lines, wherein each of the plurality of transmission lines has an electrical length corresponding to a phase of 0 degrees at an operating signal frequency.

2. The power transforming device as in claim 1, wherein the device forms a radial power combiner divider circuit.

3. The power transforming device as in claim 2, wherein the radial power combiner divider circuit combines an input power level at each of the plurality of transmission lines to produce a single output power level at the port.

4. The power transforming device as in claim 2, wherein the radial power combiner divider circuit divides a single input power level at the port into a plurality of output power levels at each of the plurality of transmission lines.

5. The power transforming device as in claim 4, wherein the radial power combiner divider circuit supports a single frequency band.

6. The power transforming device as in claim 1, wherein a physical dimension of the device is a function of the phase.

7. The power transforming device as in claim 6, wherein the (CRLH)-based structure is formed using lumped elements or distributed lines.

8. The power transforming device as in claim 6, wherein the (CRLH)-based structure is formed in a vertical configuration.

9. The power transforming device as in claim 1, wherein the port includes a feed line structure.

10. The power transforming device as in claim 9, wherein the port is formed using a conventional right-handed transmission line.

11. The power transforming device as in claim 9, wherein the port is formed using the (CRLH)-based structure.

12. The power transforming device as in claim 9, wherein the port has an electrical length corresponding to a phase of 90 degrees or an odd multiple of 90 degrees at the operating signal frequency.

13. The power transforming device as in claim 12, wherein the port has an impedance defined by the plurality of transmission lines.

14. The power transforming device as in claim 1, wherein the electrical length of each of the plurality of transmission lines determines a phase value at a given frequency.

15. The power transforming device as in claim 1, wherein the (CRLH)-based structure is comprised of a right-handed series inductance, a right-handed shunt capacitance, a left-handed series capacitance, and a left-handed shunt inductance.

16. The power transforming device as in claim 15, wherein the right-handed series inductance, the right-handed shunt capacitance, the left-handed series capacitance, and the left-handed shunt inductance are spatially distributed.

17. A power transforming device, comprising:

a plurality of transmission lines, wherein at least one of the plurality of transmission lines is a composite right and left handed (CRLH)-based structure; and a port coupled to the plurality of transmission lines, wherein each of the plurality of transmission lines has an electrical length corresponding to a phase of ±180*N degrees at a first frequency range and a phase of ±180*M degrees at a second frequency range, wherein M=N−1 and N is any integer including zero.

18. The power transforming device as in claim 17, wherein the device forms a radial power combiner divider circuit.

19. The power transforming device as in claim 18, wherein the radial power combiner divider circuit supports multi-band frequencies.

20. The power transforming device as in claim 19, wherein the (CRLH)-based structure is comprised of a right-handed series inductance, a right-handed shunt capacitance, a left-handed series capacitance, and a left-handed shunt inductance.

21. The power transforming device as in claim 20, wherein the multi-band frequencies are comprised of at least two selectable frequencies corresponding with at least two phases.

22. The power transforming device as in claim 21, wherein a configuration of the right-handed series inductance, the right-handed shunt capacitance, the left-handed series capacitance, and the left-handed shunt inductance is a function of the at least two selectable frequencies.

23. The power transforming device as in claim 17, wherein the first frequency range is non-harmonically related to the second frequency range.

24. A method for a power combiner, comprising:

receiving a plurality of power levels from a plurality of transmission lines, wherein at least one of the plurality of transmission lines is a composite right and left handed (CRLH)-based structure; and combining the plurality of power levels to a single power level at a port coupled to the plurality of transmission lines, wherein the each of the plurality of transmission lines has an electrical length corresponding to a phase of 0 degrees.

25. A method for a power divider, comprising:

receiving a single power level at a port; and distributing the single power level from the port to a plurality of transmission lines, wherein each of the plurality of transmission lines is coupled to the port and at least one transmission line is a composite right and left handed (CRLH)-based structure, wherein the each of the plurality of transmission lines has an electrical length corresponding to a phase of 0 degrees.

26. A method for a power combiner, comprising:

receiving a plurality of power levels from a plurality of transmission lines, wherein at least one of the plurality of transmission lines is a composite right and left handed (CRLH)-based structure; and combining the plurality of power levels to a single power level at a port coupled to the plurality of transmission lines, wherein each of the plurality of transmission lines has an electrical length corresponding to a phase of ±180*N degrees at first frequency range and a phase of ±180*M degrees at a second frequency range, wherein M=N−1 and N is an integer including zero.

27. A method for a power divider, comprising:

receiving a single power level at a port; and distributing the single power level from the port to a plurality of transmission lines, wherein each transmission line is coupled to the port and at least one transmission line is a composite right and left handed (CRLH)-based structure, wherein each transmission line has an electrical length corresponding to a phase of ±180*N degrees at first frequency range and a phase of ±180*M degrees at a second frequency range, wherein M=N−1 and N is an integer including zero.

* * * * *

UNITED STATES PATENT AND TRADEMARK OFFICE

CERTIFICATE OF CORRECTION

PATENT NO. : 8,294,533 B2
APPLICATION NO. : 12/896179
DATED : October 23, 2012
INVENTOR(S) : Dupuy et al.

It is certified that error appears in the above-identified patent and that said Letters Patent is hereby corrected as shown below:

On the Title Page, in Item [57], under "ABSTRACT", in Column 2, Lines 1-2, delete "composite left and right handed" and insert -- composite right and left handed --, therefor.

On Title Page 2, in Item [56], under "OTHER PUBLICATIONS", in Column 2, Line 5, delete "fo" and insert -- of --, therefor.

On Title Page 2, in Item [56], under "OTHER PUBLICATIONS", in Column 2, Line 11, delete "Magazine" and insert -- Magazine, --, therefor.

On Title Page 2, in Item [56], under "OTHER PUBLICATIONS", in Column 2, Line 23, delete "36" and insert -- 36, --, therefor.

In the Drawings

Fig. 10, Drawing Sheet 10 of 25, for Tag "1020", delete "Mutli-band" and insert -- Multi-band --, therefor at each occurrence throughout the figure.

Fig. 13, Drawing Sheet 13 of 25, delete "Phase [degree]" and insert -- Phase [degrees] --, therefor.

Fig. 16, Drawing Sheet 16 of 25, for Tag "1020", delete "Mutli-band" and insert -- Multi-band --, therefor at each occurrence throughout the figure.

In the Specification

Column 1, Line 36, delete "Composite Left and Right Handed" and insert -- Composite Right and Left Handed --, therefor.

Signed and Sealed this
Twenty-fifth Day of March, 2014

Michelle K. Lee

Michelle K. Lee
*Deputy Director of the United States Patent and Trademark Office*

Column 1, Lines 58-59, delete "composite left and right handed" and insert -- composite right and left handed --, therefor.

Column 5, Line 41, delete "CRHL" and insert -- CRLH --, therefor.

Column 8, Line 67, delete "tt" and insert -- at --, therefor.

Column 11, Line 34, delete "by" and insert the same at line 37, before "way of".

Column 11, Line 51, delete "dividers" and insert -- dividers. --, therefor.

Column 11, Line 56, delete "f1" and insert -- $f_1$ --, therefor.

Column 11, Line 57, delete "f2." and insert -- $f_2$. --, therefor.

Column 16, Line 19, delete "$S_{21@2\ 44}$" and insert -- $S_{21@2.44}$ --, therefor.

In the Claims

Column 18, Line 26, in Claim 24, delete "0 degrees." and insert the same at line 25, after "phase of", as a continuation of the paragraph.